US009141079B2

(12) United States Patent
Sato

(10) Patent No.: US 9,141,079 B2
(45) Date of Patent: Sep. 22, 2015

(54) IMAGE FORMING APPARATUS HAVING DEVELOPER CARTRIDGE AND CARTRIDGE SUPPORTING MEMBER

(71) Applicant: Brother Kogyo Kabushiki Kaisha, Nagoya-shi, Achi-ken (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/480,221

(22) Filed: Sep. 8, 2014

(65) Prior Publication Data

US 2014/0376961 A1 Dec. 25, 2014

Related U.S. Application Data

(63) Continuation of application No. 13/423,320, filed on Mar. 19, 2012, now Pat. No. 8,913,919.

(30) Foreign Application Priority Data

Jul. 29, 2011 (JP) ..... 2011-167117

(51) Int. Cl.
*G03G 15/00* (2006.01)
*G03G 15/08* (2006.01)
(Continued)

(52) U.S. Cl.
CPC ..... *G03G 21/1676* (2013.01); *G03G 15/0126* (2013.01); *G03G 15/0875* (2013.01);
(Continued)

(58) Field of Classification Search
CPC ..... G03G 15/0178; G03G 21/1663; G03G 21/1647; G03G 21/1807; G03G 21/1853; G03G 2215/0103; G03G 2215/0119; G03G 2221/1603; G03G 2221/1684; G03G 21/1676; G03G 15/0126; G03G 15/0877; G03G 15/0889; G03G 21/1642; G03G 15/0875; G03G 21/1619; G03G 21/2215; G03G 21/0141
USPC ..... 399/110, 111, 112, 113, 258
See application file for complete search history.

(56) References Cited

U.S. PATENT DOCUMENTS 6,597,882 B1 7/2003 Tanaka
7,463,847 B2 12/2008 Sato
(Continued)

FOREIGN PATENT DOCUMENTS

CN 1797224 A 7/2006
CN 101046657 A 10/2007
(Continued)

OTHER PUBLICATIONS

Co-pending U.S. Appl. No. 13/423,338, filed Mar. 19, 2012.
(Continued)

*Primary Examiner* — Robert Beatty
(74) *Attorney, Agent, or Firm* — Banner & Witcoff, Ltd.

(57) ABSTRACT

In an image forming apparatus, each of a plurality of image forming units includes a receiving member formed with a reception opening configured to receive developer. Each of a plurality of developer cartridges includes a supply member formed with a supply opening through which developer is configured to be supplied to a corresponding one of the plurality of image forming units. A cartridge supporting member is mounted in a main casing and configured to move between a first position and a second position. The supply opening and the reception opening are in communication with each other when the cartridge supporting member is in the first position and the cartridge supporting member is pulled outside the main casing when the cartridge supporting member is in the second position. One of the receiving member and the supply member protrudes toward remaining one, and the remaining one is configured to receive the one.

6 Claims, 14 Drawing Sheets

(51) Int. Cl.

| | |
|---|---|
| ***G03G 21/00*** | (2006.01) |
| ***G03G 21/16*** | (2006.01) |
| ***G03G 15/01*** | (2006.01) |

(52) U.S. Cl.

CPC ..... *G03G15/0877* (2013.01); *G03G 15/0889* (2013.01); *G03G 21/1619* (2013.01); *G03G 21/1642* (2013.01); *G03G 2215/0141* (2013.01); *G03G 2221/1684* (2013.01)

(56) References Cited

U.S. PATENT DOCUMENTS

| | | | |
|---|---|---|---|
| 7,657,206 | B2 | 2/2010 | Sato |
| 7,778,556 | B2 | 8/2010 | Ohkawa et al. |
| 8,027,620 | B2 | 9/2011 | Sakuma |
| 8,036,578 | B2 | 10/2011 | Nishikawa |
| 8,095,048 | B2 | 1/2012 | Awano et al. |
| 8,190,069 | B2 | 5/2012 | Saiki et al. |
| 8,244,155 | B2 | 8/2012 | Kouda |
| 8,396,392 | B2 | 3/2013 | Takakuwa et al. |
| 2002/0085857 | A1 | 7/2002 | Kim et al. |
| 2006/0140674 | A1 | 6/2006 | Sato |
| 2007/0223947 | A1 | 9/2007 | Ohkawa et al. |
| 2007/0223972 | A1 | 9/2007 | Isomura |
| 2008/0025758 | A1 | 1/2008 | Sato |
| 2009/0297209 | A1 | 12/2009 | Nakajima et al. |
| 2009/0317133 | A1 | 12/2009 | Nishimura et al. |
| 2010/0092196 | A1 | 4/2010 | Mimura |
| 2010/0239313 | A1 | 9/2010 | Maeda |
| 2010/0247156 | A1 | 9/2010 | Awano et al. |
| 2010/0266310 | A1 | 10/2010 | Saiki et al. |
| 2010/0272477 | A1 | 10/2010 | Nishikawa |
| 2011/0299882 | A1 | 12/2011 | Tanaami et al. |
| 2013/0028632 | A1 | 1/2013 | Sato et al. |

FOREIGN PATENT DOCUMENTS

| | | | |
|---|---|---|---|
| CN | 101512442 | A | 8/2009 |
| CN | 101846927 | A | 9/2010 |
| CN | 101866129 | A | 10/2010 |
| EP | 1821157 | A2 | 8/2007 |
| JP | 2008-026828 | A | 2/2008 |
| JP | 2008-026830 | A | 2/2008 |
| JP | 2009-020375 | A | 1/2009 |
| JP | 2009-288473 | | 12/2009 |
| JP | 2010-230899 | | 10/2010 |
| JP | 2011-145707 | A | 7/2011 |

OTHER PUBLICATIONS

CN Notification of First Office Action mailed Dec. 23, 2013, CN Appln. 201210091050.6, English translation.

Extended EP Search Report mailed Apr. 1, 2014 in EP Appln. 12159925.2.

Extended EP Search Report mailed Apr. 1, 2014 in EP Appln. 12159899.9.

Non-Final Office Action received in corresponding U.S. Appl. No. 13/423,338 mailed May 23, 2014.

Jul. 9, 2014—(CN) Notification of First Office Action—App 201210086261.0—Eng tran.

Jul. 24, 2014—(CN) Notification of the Second Office Action—App 201210091050.6—Eng tran.

Dec 18, 2014—(CN) Notification of the Second Office Action—App 201210086261.0, Eng Tran.

Mar. 20, 2015—(US) Final Office Action—U.S. Appl. No. 13/423,338.

May 26, 2015—(JP) Office Action—App 2011-167116, Eng Tran.

Jul. 17, 2015—(US) Notice of Allowance—U.S. Appl. No. 13/423,338.

IMAGE FORMING APPARATUS HAVING DEVELOPER CARTRIDGE AND CARTRIDGE SUPPORTING MEMBER

CROSS-REFERENCE TO RELATED APPLICATION

This application is a continuation of U.S. patent application Ser. No. 13/423,320, filed on Mar. 19, 2012, which claims priority from Japanese Patent Application No. 2011-167117 filed Jul. 29, 2011. The contents of the above noted applications are incorporated herein by reference in their entirety.

TECHNICAL FIELD

The present invention relates to an image-forming device employing an electrophotographic system and a developer cartridge.

BACKGROUND

One electrophotographic color printer known in the art is a tandem-type color laser printer. This printer has four photosensitive members and four developing rollers for supplying toner to respective photosensitive members, the photosensitive members and developing rollers provided respectively for the toner colors yellow, magenta, cyan, and black.

An example of this type of tandem color laser printer that is disclosed in Japanese Patent Application Publication No. 2010-230899 includes an image-forming unit having photosensitive members and developing rollers; and toner cartridges accommodating toner.

The image-forming unit in this type of printer is centrally disposed inside the printer, while the toner cartridges are detachably provided in a lateral section of the printer.

SUMMARY

However, the toner cartridges in the conventional printer described above are mounted in and removed from the lateral section of the printer (that is, a cartridge-accommodating section) in the axial direction of the photosensitive member. Consequently, the printer must be installed such that a large space is available on the side of the printer for mounting and removing the toner cartridges. Hence, this configuration can make it difficult to install the printer in a small space (i.e., the structure is not conducive to reducing the required installation space of the printer).

This printer configuration is also not conducive to installation on shelves and in other locations with limited space above and to the side of the printer, thereby reducing the user's options for locations in which the printer can be installed.

Therefore, it is an object of the present invention to provide an image-forming apparatus provided with developer cartridge that can reduce the required installation space and increase the user's freedom in choosing locations for installing the device.

In order to attain the above and other objects, there is provided an image forming apparatus including: a main casing; a plurality of image forming units; a plurality of developer cartridges; and a cartridge supporting member. Each of the plurality of image forming units may include a photosensitive drum, a developer carrying member disposed in confrontation with the photosensitive drum, and a receiving member formed with a reception opening configured to receive developer. Each of the plurality of developer cartridges may be configured to be provided for each of the plurality of image forming units. Each of the plurality of developer cartridges may include a developer accommodating section configured to accommodate developer and a supply member formed with a supply opening through which developer in the developer accommodating section is configured to be supplied to a corresponding one of the plurality of image forming units. The cartridge supporting member may be configured to detachably support each of the plurality of developer cartridges. The cartridge supporting member may be configured to move between a first position and a second position. The cartridge supporting member may be mounted in the main casing. The supply opening and the reception opening may be in communication with each other when the cartridge supporting member is in the first position. The cartridge supporting member may be pulled outside the main casing from the first position when the cartridge supporting member is in the second position. One of the receiving member and the supply member may protrude toward remaining one of the receiving member and the supply member. The remaining one of the receiving member and the supply member may be configured to receive the one of the receiving member and the supply member.

DETAILED DESCRIPTION

1. Overall Structure of a Printer

Figure 1:
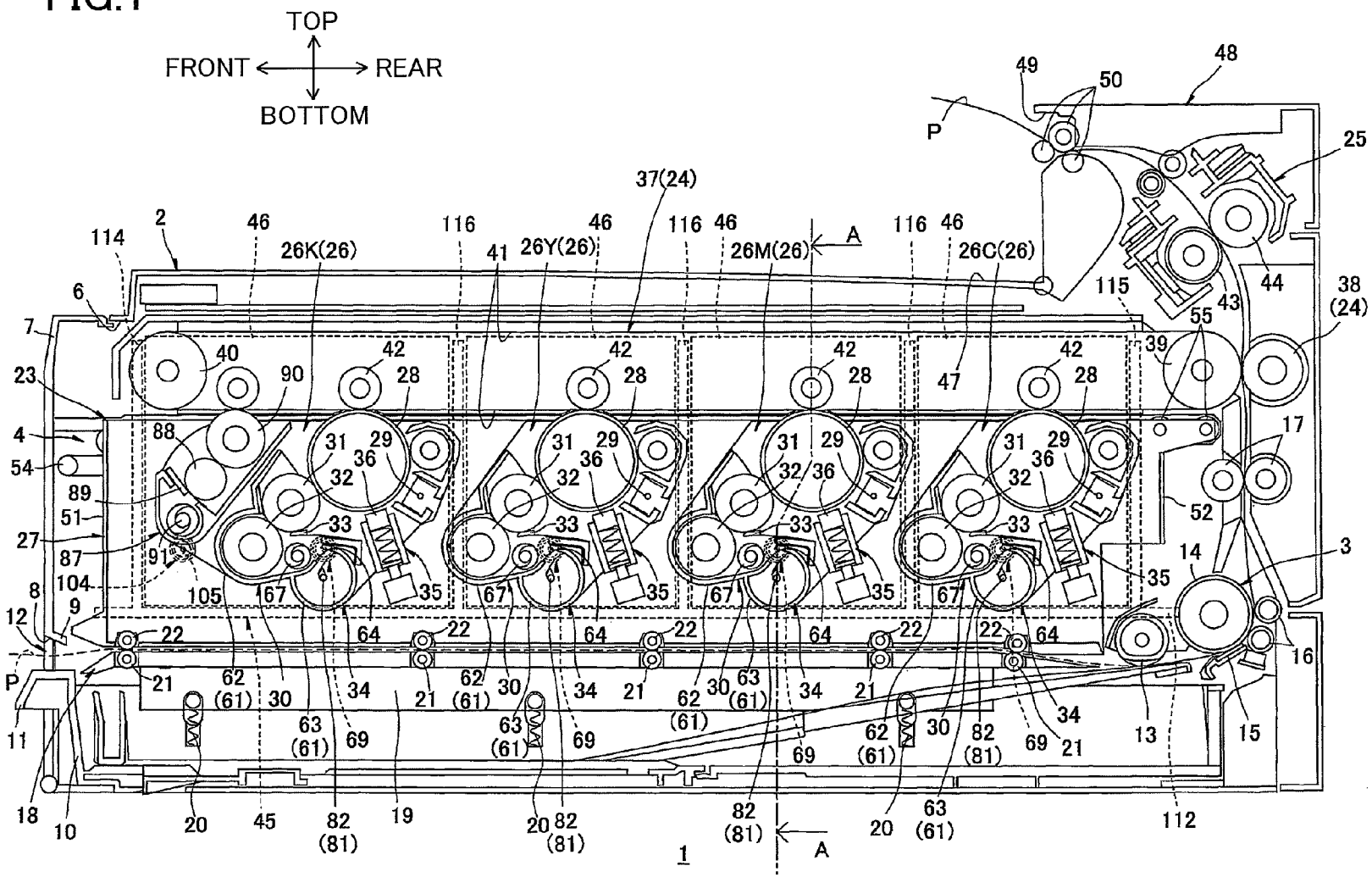
FIG. 1 is a cross-sectional view of a color printer according to an embodiment of the present invention.
Figure 2:
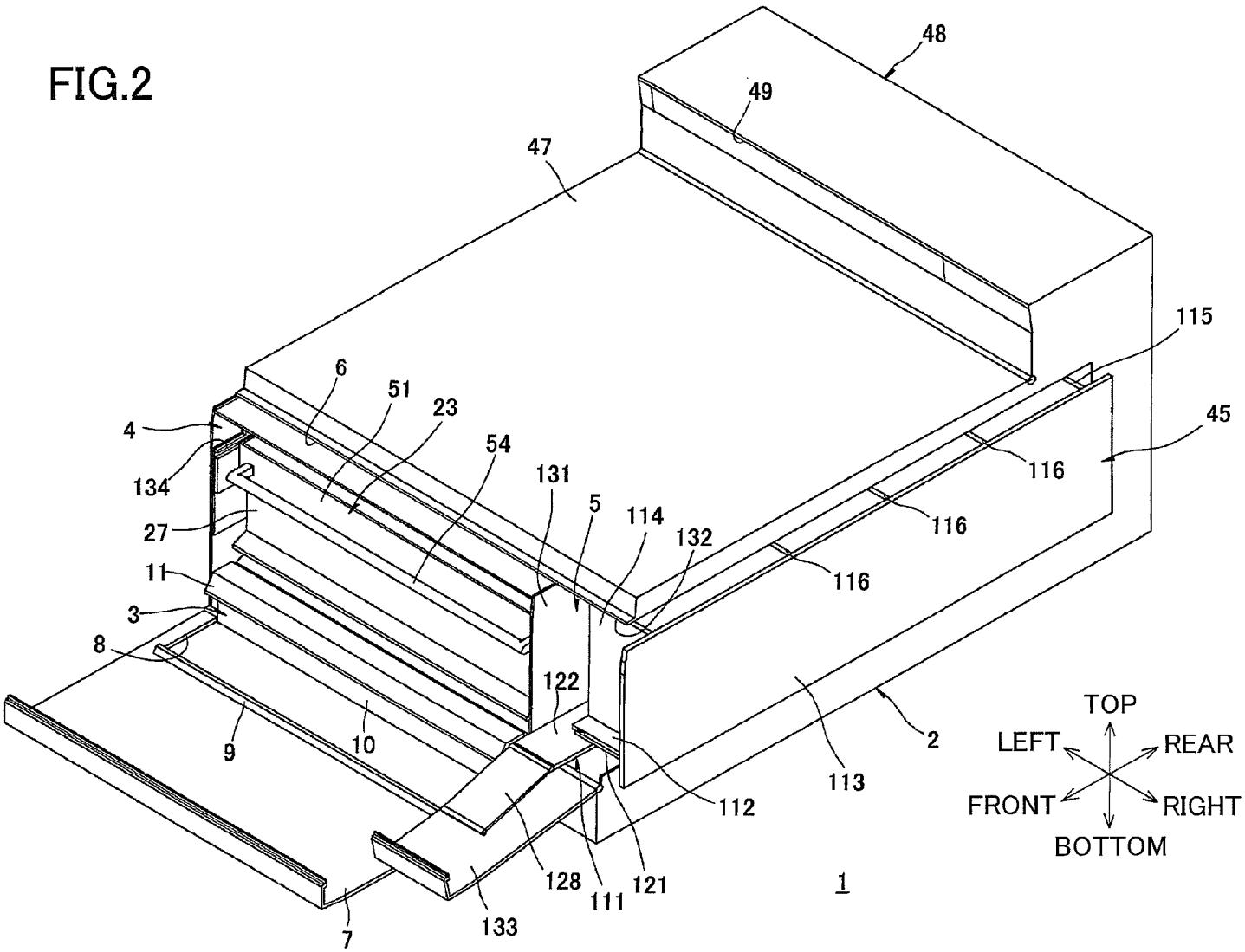
FIG. 2 is a perspective view of the color printer in FIG. 1, wherein a process-side front cover and a cartridge-side front cover are opened.

FIGS. 1 and 2 show a printer 1 serving as an example of the image-forming apparatus of the present invention. The printer 1 is an intermediate transfer tandem-type color printer.

The printer 1 includes a main casing 2 constituting the device body, a sheet-feeding unit 3 for feeding sheets of a paper P to be printed. An image-forming unit 4 for forming images on the paper P supplied by the sheet-feeding unit 3, and a toner-cartridge-accommodating section 5 for accommodating toner cartridges 46 (described later).

(1) Main Casing

The main casing 2 has a substantially rectangular box shape in a side view. A process-side access opening 6 is formed in a side wall of the main casing 2. A process-side front cover 7 is pivotably (movably) disposed on the same side wall of the main casing 2. The front cover 7 is capable of pivoting about its lower end between a closed position for closing the access opening 6 and an open position for exposing the access opening 6.

An opening 8 that exposes the front end portion of a paper tray 10 (described later) is formed in a lower portion of the front cover 7. A manual-paper-feed guide 9 provided on the front cover 7 extends obliquely rearward and downward from the upper edge of the opening 8 toward a position between the bottom wall of a process frame 27 (described later) and the front end portion of a paper-feeding member 18 (described later).

In the following description, the side of the main casing 2 on which the front cover 7 is provided (the left side in FIG. 1) will be called the "front side," and the opposite side (the right side in FIG. 1) will be called the "rear side." Further, the left and right sides of the main casing 2 will be based on the perspective of a user facing the front side of the printer 1. In other words, the near side in FIG. 1 will be the "right side," while the far side will be the "left side."

(2) Sheet-Feeding Unit

The sheet-feeding unit 3 includes a paper tray 10 for accommodating sheets of paper P.

The paper tray 10 is removably mounted in the bottom section of the main casing 2. A grip part 11 is provided on the front wall of the paper tray 10 near the top edge thereof. The grip part 11 has a general U-shape in cross section, with the opening of the U-shape facing downward. The top surface of the grip part 11 vertically opposes the manual-paper-feed guide 9, with a gap formed therebetween. The gap formed between the top surface of the grip part 11 and the manual-paper-feed guide 9 defines a manual-paper-feed opening 12 through which sheets of paper P other than those accommodated in the paper tray 10 may be hand-fed.

The sheet-feeding unit 3 also includes a pick-up roller 13 disposed above the rear end of the paper tray 10, a feeding roller 14 disposed to the rear of the pick-up roller 13, a feeding pad 15 disposed so as to confront the feeding roller 14 from the bottom side thereof, a pair of top and bottom pinch rollers 16 disposed in contact with the rear side of the feeding roller 14, and a pair of registration rollers 17 disposed above the feeding roller 14 and opposing each other in the front-to-rear direction.

The pick-up roller 13 rotates to supply sheets of paper P accommodated in the paper tray 10 (indicated by a solid line in FIG. 1) between the feeding roller 14 and feeding pad 15, whereby the rotation of the feeding roller 14 separates and feeds the paper one sheet at a time. The rotating feeding roller 14 subsequently supplies each sheet of paper P so as to pass sequentially between the feeding roller 14 and pinch rollers 16 and enter between the registration rollers 17 disposed above the feeding roller 14. The registration rollers 17 rotate in order to supply the sheets to the image-forming unit 4 (between an intermediate transfer belt 41 and a secondary transfer roller 38, both described later) at a prescribed timing. This feed path extending from the paper tray 10 to the image forming unit 4 through the pick-up roller 13, the feeding roller 14, the feeding pad 15, the pair of pinch rollers 16, and the pair of registration rollers corresponds to a first feed path.

A manual-paper-feed path corresponding to second feed path is formed in the sheet-feeding unit 3 between the paper tray 10 and the bottom wall of a process frame 27 (described later).

A paper-feeding member 18 is provided in the paper tray 10. The paper-feeding member 18 constitutes the bottom wall of the manual-paper-feed path and confronts the bottom wall of a process frame 27 (described later).

The paper-feeding member 18 has a generally flat plate shape that is elongated in the front-to-rear direction. The paper-feeding member 18 is disposed on the upper edges of the paper tray 10 by means of a pair of left and right support plates 19 and various compression springs 20.

Five tray-side feeding members 21 are rotatably provided in the paper-feeding member 18 at intervals in the front-to-rear direction. While a process frame 27 will be described later, five process-side feeding members 22 are rotatably provided on the bottom wall of the process frame 27 at positions opposing the tray-side feeding members 21.

The paper P hand-fed through the manual-paper-feed opening 12 (indicated by a dashed line in FIG. 1) is guided by the manual-paper-feed guide 9 on the front cover 7 and the top surface of the grip part 11 provided on the paper tray 10 to a nip part between the forwardmost process-side feeding members 22 and the forwardmost tray-side feeding members 21. Each of the process-side feeding members 22 is driven to rotate while the corresponding tray-side feeding members 21 follow, conveying the hand-fed sheet in a rearward direction between the bottom surface of a process frame 27 (described later) and the top surface of the paper-feeding member 18.

The hand-fed sheets of paper P are guided to the pick-up roller 13 at the rear end of the paper-feeding member 18 and conveyed between the feeding roller 14 and feeding pad 15 by the rotation of the pick-up roller 13, as described above. The rotating feeding roller 14 then supplies the sheets of paper P sequentially through the feeding roller 14 and pinch rollers 16 to the nip part between the registration rollers 17 disposed above the feeding roller 14. The rotating registration rollers 17 supply the sheets between an intermediate transfer belt 41 and secondary transfer roller 38, both described later, at a prescribed timing. The manual-paper-feed path corresponds to a feed path extending from the manual-paper-feed opening 12 to the pick-up roller 13 through the tray-side feeding members 21 and the process-side feeding members 22.

(3) Image-Forming Unit

The image-forming unit 4 is disposed above the sheet-feeding unit 3 and includes a process unit 23, a transfer unit 24, and a fixing unit 25.

(3-1) Process Unit

The process unit 23 is movably disposed above the paper tray 10 in front of the pick-up roller 13. The process unit 23 is capable of moving in the front and rear directions between a mounted position in which the process unit 23 is mounted in the main casing 2 (see FIG. 1), and a pulled-out position in which the process unit 23 is pulled out of the main casing 2 (see FIG. 9).

The process unit 23 includes four process cartridges 26 as an image forming unit corresponding to the four colors used in image formation, and a process frame 27 for retaining the process cartridges 26 in a detachably mounted state.

The process cartridges 26 are juxtaposedly arranged parallel to one another and spaced at intervals in the front-to-rear direction (a predetermined direction). More specifically, the process cartridges 26 include, in order from front to rear, a black process cartridge 26K, a yellow process cartridge 26Y, a magenta process cartridge 26M, and a cyan process cartridge 26C.

Each process cartridge 26 integrally holds a photosensitive drum 28, a Scorotron charger 29, and a developing device 30.

The photosensitive drum 28 has a generally cylindrical shape and is oriented with its axis aligned in the left-to-right direction.

The Scorotron charger 29 is disposed below and rearward of the corresponding photosensitive drum 28. The Scorotron charger 29 confronts but is separated from the photosensitive drum 28.

The developing device 30 is disposed below and forward of the corresponding photosensitive drum 28. The developing device 30 is provided with a developing roller 31 as a developer supporting member.

The developing roller 31 is rotatably supported in the top of the developing device 30 and is disposed in confrontation with the photosensitive drum 28. A portion of the surface of the developing roller 31 is exposed when viewed from above the developing device 30 (obliquely above and rearward of the developing device 30) and contacts the photosensitive drum 28 on the lower front side.

Each developing device 30 also includes a supply roller 32 for supplying toner to the developing roller 31, and a thickness-regulating blade 33 for regulating the thickness of toner carried on the developing roller 31. Each developing device 30 also includes a toner reservoir 34 disposed below and rearward of the supply roller 32 for storing toner supplied from a toner cartridge 46 (described later).

The black process cartridge 26K also includes a belt-cleaning roller 90, a waste toner reservoir 87, a relay roller 88, and a scraping blade 89.

The belt-cleaning roller 90 is rotatably supported in the black process cartridge 26K in front of the corresponding photosensitive drum 28 and is positioned for contacting the lower portion of an intermediate transfer belt 41 (described later) from below.

The belt-cleaning roller 90 functions to clean off any toner remaining on the surface of the intermediate transfer belt 41 (described later). The relay roller 88 temporarily retains toner cleaned off by the belt-cleaning roller 90. The toner is subsequently scraped off the relay roller 88 by the scraping blade 89 and is collected in the waste toner reservoir 87.

An auger screw 91 is rotatably provided in the waste toner reservoir 87 of the black process cartridge 26K. The auger screw 91 conveys waste toner collected in the waste toner reservoir 87 to a waste-toner-collecting unit (not shown) provided in the black toner cartridge 46 (described later).

The process frame 27 provided in the main casing 2 is capable of sliding in forward and rearward directions. The process frame 27 includes four LED units 35 corresponding to the four photosensitive drums 28.

Each LED unit 35 is disposed on the rear side of the corresponding developing device 30 so as to face the bottom of the corresponding photosensitive drum 28. Each LED unit 35 also includes an LED array 36 having a plurality of LEDs arrayed in the left-to-right direction. The LED unit 35 functions to expose the surface of the corresponding photosensitive drum 28 based on prescribed image data.

(3-2) Transfer Unit

The transfer unit 24 includes a belt unit 37, and a secondary transfer roller 38.

The belt unit 37 is positioned above the process unit 23 when the process unit 23 is in the mounted position. The belt unit 37 is oriented in the front-to-rear direction so as to confront each of the photosensitive drums 28 from above.

The belt unit 37 includes a drive roller 39, a follow roller 40, an intermediate transfer belt 41, and four primary transfer rollers 42.

The drive roller 39 and follow roller 40 are separated in the front-to-rear direction.

The intermediate transfer belt 41 is placed around the drive roller 39 and follow roller 40 such that its lower portion contacts each of the photosensitive drums 28. When the drive roller 39 is driven to rotate, the intermediate transfer belt 41 circulates such that the lower portion of the intermediate transfer belt 41 that contacts each of the photosensitive drums 28 moves in a rearward direction.

The primary transfer rollers 42 are disposed so as to confront the corresponding photosensitive drums 28 with the lower portion of the intermediate transfer belt 41 interposed therebetween.

The secondary transfer roller 38 is provided on the rear side of the belt unit 37 and confronts the drive roller 39 of the belt unit 37 with the intermediate transfer belt 41 interposed therebetween.

(3-3) Fixing Unit

The fixing unit 25 is disposed above the secondary transfer roller 38. The fixing unit 25 includes a heating roller 43, and a pressure roller 44 that confronts the heating roller 43.

(4) Toner-Cartridge-Accommodating Section

Figure 3:
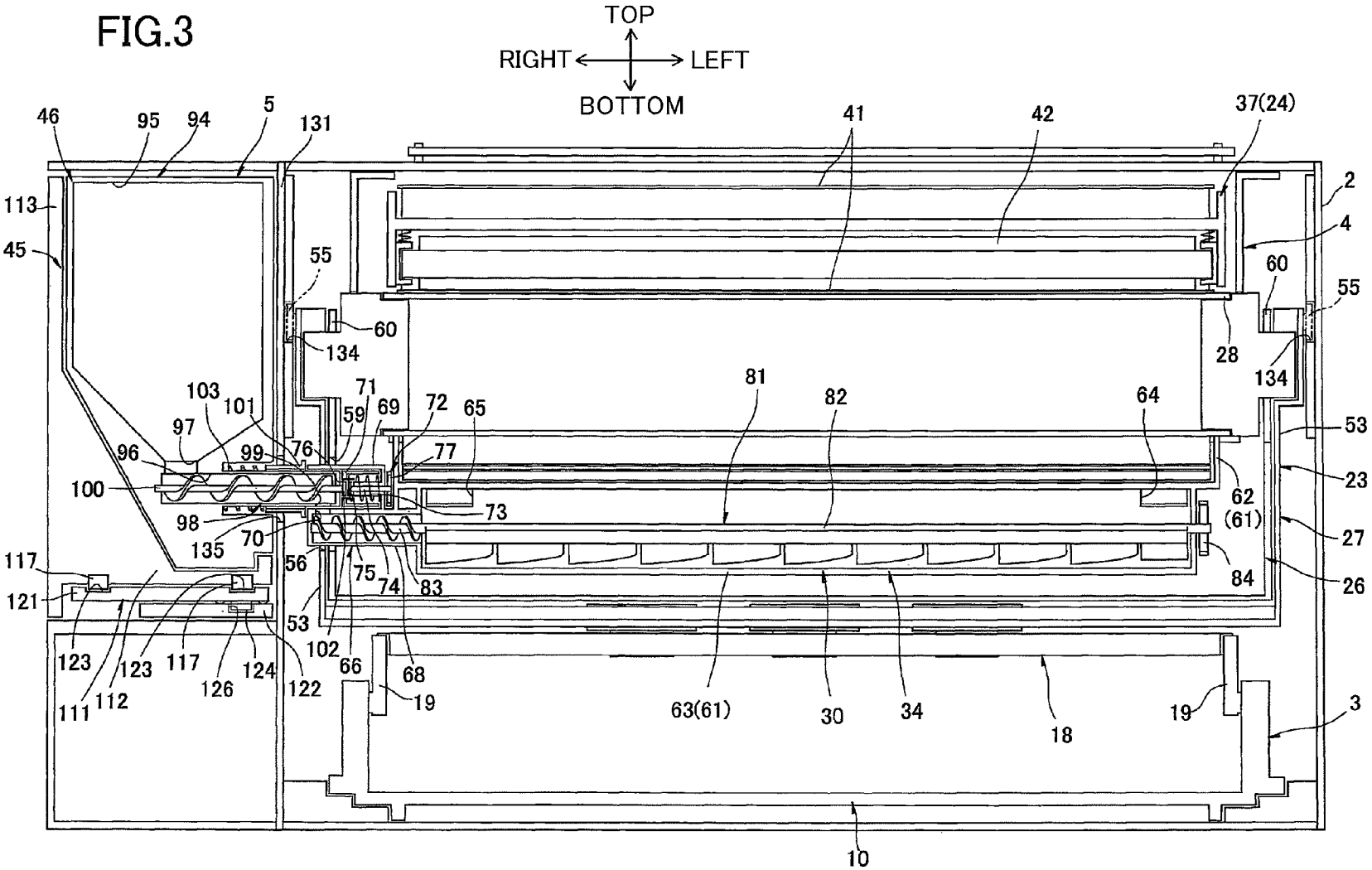
FIG. 3 is a cross-sectional view of the color printer taken along a line A-A of FIG. 1, wherein a toner cartridge drawer is in a mounted position.

As shown in FIGS. 2 and 3, the toner-cartridge-accommodating section 5 is formed on the right side of the process unit 23 by depressing leftward from the right end of the main casing 2. A substantially rectangular shaped space in a side view is defined by the toner-cartridge-accommodating section 5. A cartridge-side access opening 132 as an opening is formed in the front end of the toner-cartridge-accommodating section 5 adjacent to the process-side access opening 6 on the right thereof. A cartridge-side front cover 133 as an opening/closing member is pivotably (movably) disposed on the main casing 2. The front cover 133 is capable of pivoting about its lower end between a closed position for closing the access opening 132 and an open position for exposing the access opening 132. A toner cartridge drawer 45 as a cartridge supporting unit is accommodated in the toner-cartridge-accommodating section 5. A cartridge-side front cover 132

The toner cartridge drawer 45 integrally supports four toner cartridges 46 as a developer cartridge that each accommodates toner (developer) of a discrete color.

Figure 8:
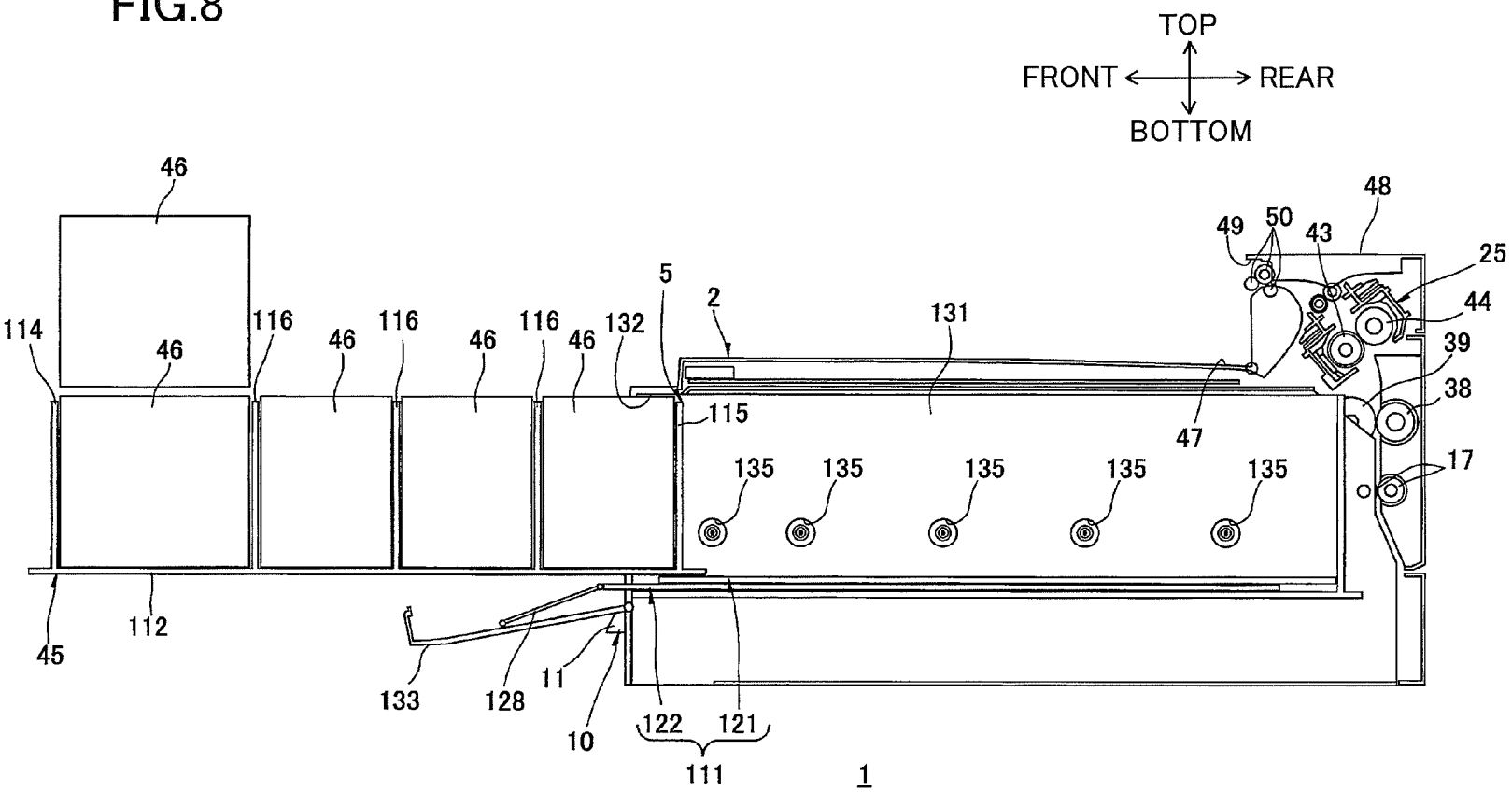
FIG. 8 is an explanatory diagram illustrating the removal and mounting of a toner cartridge relative to the toner cartridge drawer shown in FIG. 7.

The toner cartridge drawer 45 is arranged in a front-to-rear orientation so as to confront all process cartridges 26. The toner cartridge drawer 45 is capable of moving to a mounted position in which the process cartridge 26 is mounted inside the main casing 2 (see FIG. 2), a retracted position in which the process cartridge 26 is retracted rightward from the process unit 23 (see FIG. 4), and a pulled-out position in which the process cartridge 26 is pulled outside the main casing 2 (see FIG. 8).

As will be described later in greater detail, when the toner cartridge drawer 45 is in the mounted position, each of the toner cartridges 46 is arranged in a position opposing the right side of the corresponding process cartridge 26. Each of the toner cartridges 46 is coupled to the right side of the corresponding process cartridge 26 and can supply toner into the toner reservoir 34 of the process cartridge 26.

(5) Image-Forming Operation

Toner supplied into the toner reservoir 34 of the process cartridge 26 from the corresponding toner cartridge 46 is supplied from the toner reservoir 34 onto the supply roller 32, and in turn supplied onto the developing roller 31.

The thickness-regulating blade 33 regulates the thickness of toner supplied to the developing roller 31 as the developing roller 31 rotates, maintaining the toner carried on the surface of the developing roller 31 at a thin uniform thickness. Further, toner supplied to the developing roller 31 is positively tribocharged between the thickness-regulating blade 33 and developing roller 31.

In the meantime, the Scorotron charger 29 applies a uniform positive charge to the surface of the corresponding photosensitive drum 28 as the photosensitive drum 28 rotates. The LED unit 35 subsequently exposes the charged surface of the photosensitive drum 28, forming an electrostatic latent image on the surface that corresponds to an image to be printed on paper P.

As the photosensitive drum 28 continues to rotate, the positively charged toner carried on the surface of the developing roller 31 is supplied to the latent image formed on the surface of the photosensitive drum 28. The toner develops the latent image on the photosensitive drum 28 into a visible toner image through reverse development.

The toner images developed on the surfaces of all photosensitive drums 28 are sequentially transferred onto the lower portion of the intermediate transfer belt 41, as the lower portion of the intermediate transfer belt 41 moves rearward, as a primary transfer. The sequentially transferred toner images form a color image on the intermediate transfer belt 41.

The color image carried on the intermediate transfer belt 41 is subsequently transferred onto a sheet of paper P supplied from the sheet-feeding unit 3, as the sheet passes between the intermediate transfer belt 41 and secondary transfer roller 38, as a secondary transfer.

Next, the color image transferred onto the paper P is fixed to the paper P in the fixing unit 25 by heat and pressure as the sheet passes between the heating roller 43 and pressure roller 44.

(6) Paper Discharge

A discharge tray 47 is formed on the top surface of the main casing 2 for receiving sheets of paper P discharged from the main casing 2. A paper-discharge unit 48 is formed on the top portion of the main casing 2 at the rear side thereof and protrudes farther upward than the discharge tray 47.

A discharge outlet 49 is formed in the paper-discharge unit 48 at a position above the discharge tray 47. Paper is discharged from the main casing 2 through the discharge outlet 49. The paper-discharge unit 48 also includes three discharge rollers 50 disposed inside the discharge outlet 49 for conveying sheets of paper P toward the discharge tray 47.

Hence, after a toner image is fixed to the sheet of paper P in the fixing unit 25, the discharge rollers 50 discharge the sheet onto the discharge tray 47.

2. Process Unit (1) Process Frame

Figure 4:
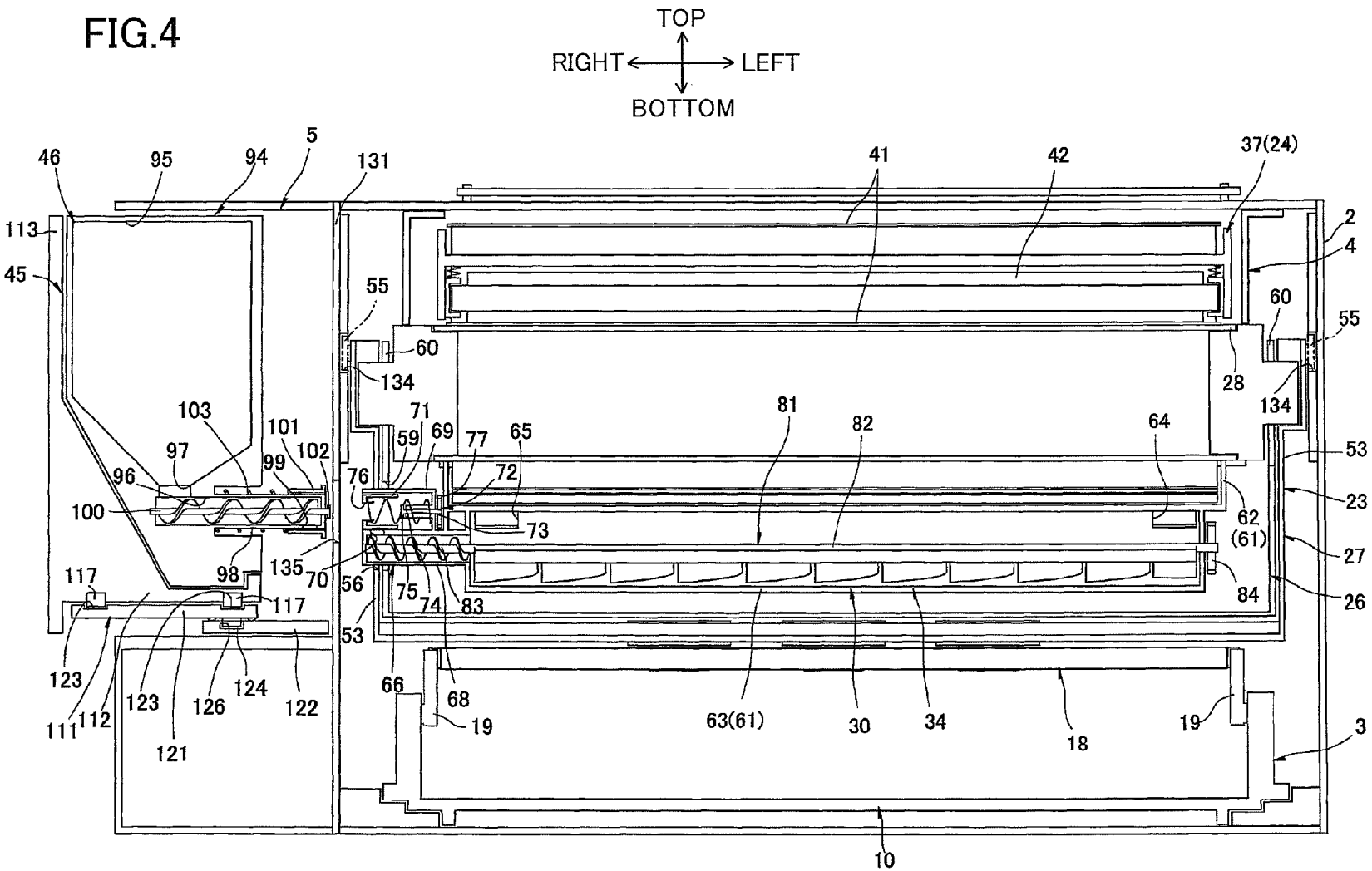
FIG. 4 is a cross-sectional view of the color printer taken along the line A-A of FIG. 1, wherein the toner cartridge drawer is in a retracted position.

As shown in FIGS. 1, 3, and 4, the process frame 27 has a generally rectangular frame-like structure with a closed bottom and open top. More specifically, the process frame 27 includes a pair of side walls 53 arranged parallel to each other and separated in the left-to-right direction, a front wall 51 bridging the front ends of the side walls 53, and a rear wall 52 bridging the rear ends of the side walls 53.

The front wall 51 has a handle 54 protruding forward therefrom.

Guide rollers 55 are rotatably provided in the upper rear end of each of the side walls 53. Although not shown in the drawings, protrusions elongated in the front-to-rear direction and protruding outward in left and right directions from the left and right side walls 53 are provided on the top edges of the side walls 53.

An exposure groove 56 is formed in the right side wall 53 for exposing a toner-receiving unit 66 (described later) of the developing device 30. The exposure groove 56 is formed as a cutout in the top edge of the right side wall 53, producing a concave groove that is recessed toward the lower side of the right side wall 53 and that is open on the top.

(2) Process Cartridge

Each process cartridge 26 is provided with a pair of left and right side plates 60, the photosensitive drum 28, the Scorotron charger 29, and the developing device 30.

The side plates 60 are generally plate-shaped and elongated vertically. The side plates 60 are disposed parallel to each other and separated in the left-to-right direction. An exposure hole 59 is formed in the right side plate 60 to expose a toner-receiving unit 66 (described later).

The photosensitive drum 28 is rotatably supported between the side plates 60. The Scorotron charger 29 spans between the side plates 60.

The developing device 30 is provided between the side plates 60. The developing device 30 also has a developer case 61.

The developer case 61 is integrally provided with a first frame 62 that supports both the developing roller 31 and supply roller 32, and a second frame 63 that defines the toner reservoir 34.

The first frame 62 has a cylindrical shape elongated in the left-to-right direction. In cross section the first frame 62 has a U-shape with the opening of the "U" facing obliquely upward and rearward. An auger screw 67 is rotatably provided in the first frame 62 to the rear of the supply roller 32. A toner supply hole 64 and a toner recovery hole 65 are both formed in the bottom rear portion of the first frame 62 at positions confronting the rear side of the auger screw 67.

The toner supply hole 64 is a generally rectangular through-hole formed in the left end portion of the first frame 62. The toner recovery hole 65 is a through-hole having substantially the same shape and dimensions as the toner supply hole 64 and is formed in the right end portion of the first frame 62. The toner supply hole 64 and toner recovery hole 65 are aligned with each other in the left-to-right direction.

The second frame 63 is provided below the rear end of the first frame 62. The second frame 63 is formed in a partial cylindrical shape and is elongated in the left-to-right direction. A cross section of the second frame 63 is generally C-shaped, opening obliquely upward and forward. More specifically, the top of the second frame 63 is formed continuously with the lower rear portion of the first frame 62, forming a continuous peripheral edge above the toner supply hole 64 and toner recovery hole 65. The upper portion of the second frame 63 is also formed continuously with the lower rear portion of the first frame 62 in the region in front of and below the bottom edges of the toner supply hole 64 and toner recovery hole 65.

The developing device 30 is further provided with a toner-receiving unit 66 as a receiving unit on the right side of the toner reservoir 34.

The toner-receiving unit 66 has a double-cylinder structure with two coupled cylinders arranged one above the other. The lower cylinder is a conveying cylinder 68, and the upper cylinder is a receiving cylinder 69 as a receiving member.

The conveying cylinder 68 is formed continuously with the right wall of the second frame 63 and extends rightward therefrom. The conveying cylinder 68 has a generally cylindrical shape with a smaller diameter than that of the second frame 63 and has a common central axis with the second frame 63. The left end of the conveying cylinder 68 that is continuously formed with the right wall of the second frame 63 opens into the interior of the second frame 63, while the right end of the conveying cylinder 68 is closed.

A toner-conveying member 81 is provided inside the second frame 63 and conveying cylinder 68.

The toner-conveying member 81 is integrally provided with an agitator 82 disposed inside the second frame 63, and an auger screw 83 disposed inside the conveying cylinder 68. The agitator 82 and auger screw 83 are formed continuously in the left-to-right direction and share the same rotational shaft. The right end of the toner-conveying member 81 is rotatably supported in the right wall of the conveying cylinder 68. The left end of the toner-conveying member 81 is rotatably supported in the left wall of the second frame 63 so as to be capable of rotating relative to the left wall, and protrudes leftward therefrom. A drive gear 84 is provided on the left end portion of the toner-conveying member 81 outside the left wall of the second frame 63 and is incapable of rotating relative to the toner-conveying member 81. A drive force generated in the main casing 2 is inputted into the drive gear 84 via a gear train (not shown).

The receiving cylinder 69 is formed in a generally cylindrical shape that is elongated in the left-to-right direction. The lower portion of the receiving cylinder 69 is connected to the top portion of the conveying cylinder 68. The right end of the receiving cylinder 69 is closed and is disposed at a position confronting the right side of the first frame 62 at a distance. The left end of the receiving cylinder 69 is open. The inner diameter of the receiving cylinder 69 is slightly larger than the outer diameter of a supply cylinder 98 (described later) of the toner cartridge 46 and is capable of receiving this supply cylinder 98. A process-side reception opening 70 as a reception opening is formed in the right end portion of the receiving cylinder 69, vertically penetrating the bottom portion of the same, and provides communication between the conveying cylinder 68 and receiving cylinder 69.

The receiving cylinder 69 further includes a process-side shutter 71 as a first shutter, and a coupling 72. The shutter 71 is generally cylindrical in shape with a closed right end and is elongated in the left-to-right direction. The shutter 71 has an outer diameter substantially equal to the outer diameter of the supply cylinder 98 (described later) and a left-to-right length equivalent to about half that of the receiving cylinder 69. A coupling exposure hole 76 is formed through the right wall of the shutter 71 for exposing a fitting member 75 (described later) of the coupling 72. The coupling exposure hole 76 has a larger diameter than that of the fitting member 75 (described later).

The shutter 71 is disposed inside the receiving cylinder 69 and is capable of sliding between an open position (see FIG. 3) in the left end of the receiving cylinder 69 for opening the reception opening 70, and a closed position (see FIG. 4) in the right end of the receiving cylinder 69 for closing the reception opening 70. A compression spring 73 is also interposed between the left wall of the receiving cylinder 69 and the right wall of the shutter 71 for constantly urging the shutter 71 rightward toward the closed position.

The coupling 72 is rotatably supported in the left wall of the receiving cylinder 69. The coupling 72 specifically includes a drive shaft 74, the fitting member 75, and a drive input gear 77.

The drive shaft 74 has a generally columnar shape and extends in the left-to-right direction. The drive shaft 74 is rotatably supported in the left wall of the receiving cylinder 69.

The fitting member 75 is provided on the right end of the drive shaft 74 and is incapable of rotating relative thereto. The fitting member 75 is generally disc-shaped and shares a central axis with the drive shaft 74.

The drive input gear 77 is provided on the left end of the drive shaft 74 and is incapable of rotating thereto. The drive input gear 77 is positioned between the receiving cylinder 69 and first frame 62 and shares a central axis with the drive shaft 74. A drive force generated from the main casing 2 is inputted into the drive input gear 77 via a gear train (not shown).

3. Toner Cartridges and Toner-Cartridge-Accommodating Section (1) Toner Cartridges As shown in FIGS. 3 and 4, each of the toner cartridges 46 includes a cartridge case 94 accommodating toner, and the supply cylinder 98 as a supply member for supplying toner in the cartridge case 94 to the toner reservoir 34 of the process cartridge 26.

The cartridge case 94 includes a lower half portion having a width in the left-to-right direction narrower than that of an upper half portion. The lower half portion of the cartridge case 94 is tapered so that its horizontal cross section grows smaller toward the bottom. Within the cartridge case 94 are formed a toner-accommodating section 95 as a developer accommodating section for accommodating toner, and a supply channel 96 for supporting the supply cylinder 98.

The toner-accommodating section 95 is provided in the upper portion of the cartridge case 94. The lower end of the toner-accommodating section 95 is tapered so that its horizontal cross section grows smaller toward the bottom. A through-hole 97 is formed in the bottom end of the toner-accommodating section 95, opening downward.

The supply channel 96 is formed in the lower end of the cartridge case 94 so as to be in communication with the through-hole 97. The supply channel 96 has a generally circular cross section and extends left-to-right. The right end of the supply channel 96 communicates with the through-hole 97 at the top edge of the supply channel 96, while the right end is closed. Further, the left end of the supply channel 96 opens leftward.

The supply cylinder 98 has a generally cylindrical shape and extends leftward from the peripheral edge on the left end of the supply channel 96. The right end of the supply cylinder 98 opens rightward and is in communication with the supply channel 96. The left end of the supply cylinder 98 is closed. A supply opening 99 is formed in the left end of the supply cylinder 98, penetrating the lower portion of the supply cylinder 98 vertically.

Each of the toner cartridges 46 further includes an auger screw 100, and a cartridge-side shutter 101 as a second shutter.

The auger screw 100 is disposed inside the supply channel 96 and supply cylinder 98 and is oriented in the left-to-right direction. The right end of the auger screw 100 is rotatably supported in the right wall of the supply channel 96, and the left end of the auger screw 100 is rotatably supported in the left wall of the supply cylinder 98 and protrudes leftward out from the left wall.

A fitting part 102 is also formed on the left end of the auger screw 100. The fitting part 102 is generally disc-shaped and shares a rotational center with the auger screw 100. The fitting part 102 is fitted with the fitting member 75 provided on the coupling 72 of the toner-receiving unit 66 so as to be incapable of rotating relative to the fitting member 75.

The shutter 101 is generally cylindrical in shape and elongated left-to-right. The shutter 101 is formed with an inner diameter substantially identical to that of the receiving cylinder 69 and with a left-to-right length substantially the same as that of the shutter 71.

The shutter 101 is fitted on the outside of the supply cylinder 98 and is capable of sliding between a closed position (see FIG. 4) on the left end of the supply cylinder 98 for closing the supply opening 99, and an open position (see FIG. 3) moved (retracted) rightward from the closed position for exposing the supply opening 99. A compression spring 103 is also interposed between the left wall of the cartridge case 94 and the right end of the shutter 101 for constantly urging the shutter 101 leftward toward the closed position.

Figure 6A:
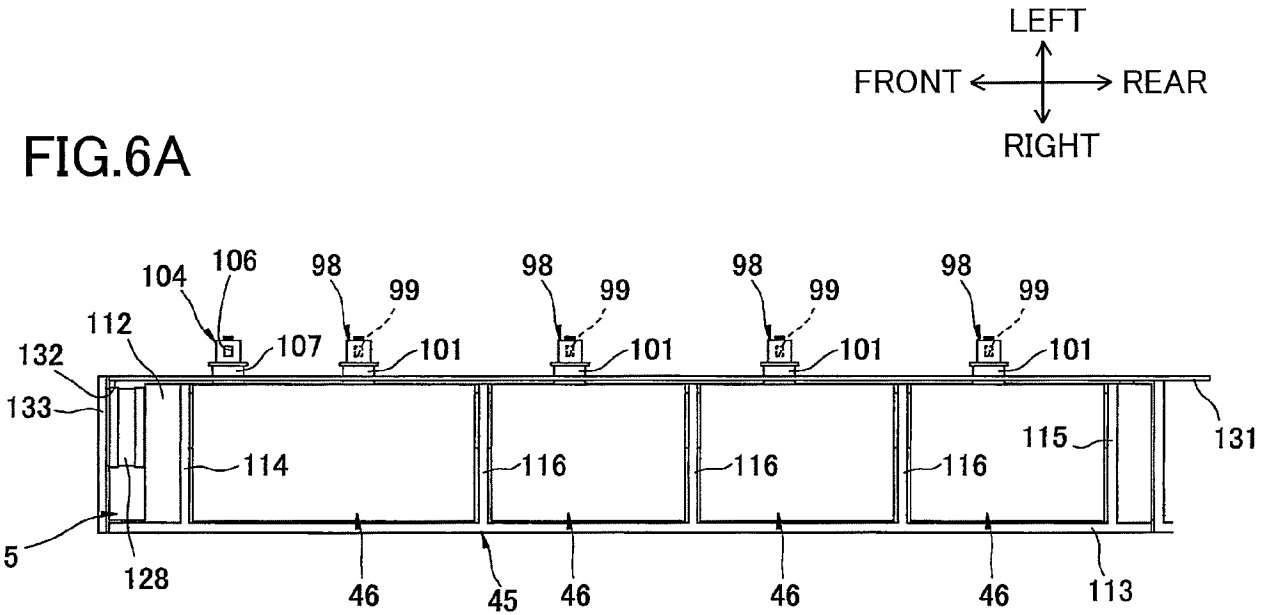
FIG. 6A is an explanatory diagram illustrating the toner-cartridge-accommodating section and illustrating a movement of the toner cartridge drawer shown in FIG. 2, wherein the cartridge-side front cover is closed and the toner cartridge drawer is in the mounted position.
Figure 6B:
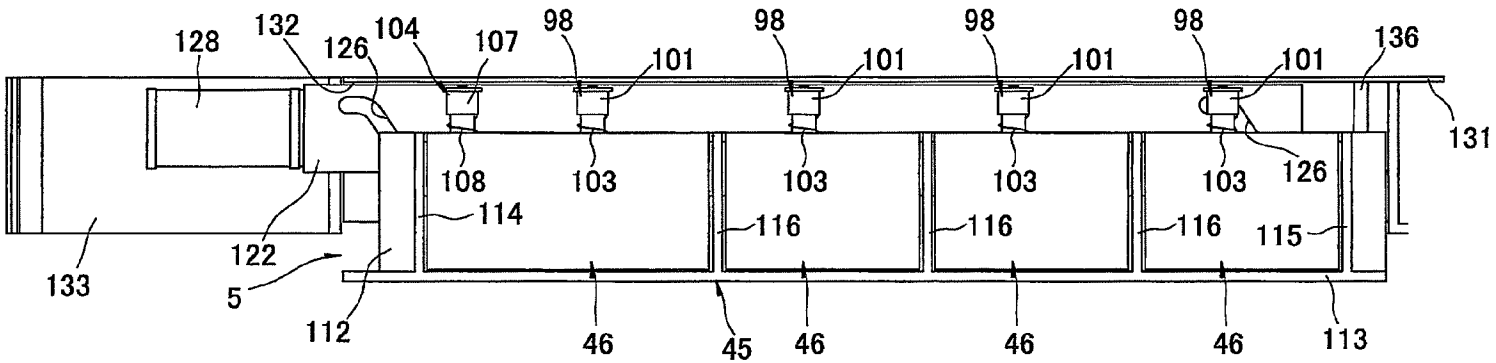
FIG. 6B is an explanatory diagram illustrating the toner-cartridge-accommodating section and illustrating the movement of the toner cartridge drawer shown in FIG. 2, wherein the cartridge-side front cover is opened and the toner cartridge drawer is in the retracted position.

As illustrated in FIGS. 1, 6A, and 6B, the black toner cartridge 46 is formed wider in the front-to-rear direction than the other toner cartridges 46 (cyan, magenta, and yellow toner cartridges 46). A waste-toner-accommodation section (not shown) is provided in the front region of the black toner cartridge 46 separately from the toner-accommodating section 95 for accommodating waste toner conveyed from the waste toner reservoir 87.

As shown in FIGS. 6A and 6B, the black toner cartridge 46 includes a waste-toner-conveying cylinder 104 coupled to the waste toner reservoir 87 of the black process cartridge 26K.

The waste-toner-conveying cylinder 104 has a generally cylindrical shape and extends leftward from a waste-toner collecting unit (not shown). An auger screw 105 (see FIG. 1) is rotatably provided in the waste-toner-conveying cylinder 104. A waste-toner-reception opening 106 (see FIG. 6A) is formed in the left end of the waste-toner-conveying cylinder 104, penetrating the top portion of the waste-toner-conveying cylinder 104 vertically. The waste-toner-reception opening 106 has a generally rectangular shape in a plan view.

A waste-toner-collecting-unit-side shutter 107 identical to the cartridge-side shutter 101 is provided on the left end of the waste-toner-conveying cylinder 104. Specifically, the shutter 107 is generally cylindrical in shape and elongated left-to-right. The inner diameter of the shutter 107 is approximately equal to the outer diameter of the waste-toner-conveying cylinder 104.

The shutter 107 is fitted on the outside of the waste-toner-conveying cylinder 104 and is capable of sliding between a closed position (see FIG. 6B) on the left end of the waste-toner-conveying cylinder 104 for closing the waste-toner-reception opening 106, and an open position (see FIG. 6A) moved (retracted) rightward from the open position for exposing the waste-toner-receiving port 106. A compression spring 108 is interposed between the left wall of the cartridge case 94 and the right end of the shutter 107 for constantly urging the shutter 107 leftward toward the closed position.

(2) Toner-Cartridge-Accommodating Section

As shown in FIGS. 2, 3, and 4, the toner-cartridge-accommodating section 5 accommodates the toner cartridge drawer 45 and a moving mechanism 111.

(2-1) Toner Cartridge Drawer

As shown in FIG. 1, the toner cartridge drawer 45 has a frame-like structure that is elongated in the front-to-rear direction. The toner cartridge drawer 45 has a closed bottom but is open on the left side. More specifically, the toner cartridge drawer 45 is integrally configured of a bottom wall 112, a right wall 113 as a side wall, a front wall 114, a rear wall 115, and three partitioning walls 116.

The bottom wall 112 has a flat plate shape that is substantially rectangular in a plan view and elongated in the front-to-rear direction. Drawer-side rollers 117 are provided on the rear edge of the bottom wall 112 near both left and right sides thereof. The drawer-side rollers 117 are fitted with play in guide grooves 123 (described later) formed in the toner-cartridge-accommodating section 5.

The right wall 113 has a flat plat shape that is substantially rectangular in a side view, elongated in the front-to-rear direction, and provided on the right side of the bottom wall 112.

The front wall 114 has a generally flat plate shape and extends upward from the front edge of the bottom wall 112. The rear wall 115 has a generally flat plate shape and extends upward from the rear edge of the bottom wall 112. The right wall 113 is disposed on an opposite side of the toner cartridges 46 from the process cartridges 26 in the left-to-right direction.

The partitioning walls 116 are arranged parallel to each other and spaced at intervals in the front-to-rear direction between the front wall 114 and rear wall 115. Each of the partitioning walls 116 has a generally flat plate shape and extends upward from the bottom wall 112. With this configuration, the toner cartridge drawer 45 is partitioned into four regions each having a front-to-rear length equivalent to the front-to-rear length of the corresponding toner cartridge 46.

Each of the toner cartridges 46 is detachably supported in the toner cartridge drawer 45 in areas defined by the front wall 114, rear wall 115, and partitioning walls 116. When the toner cartridges 46 are supported in the toner cartridge drawer 45, the right wall of the toner cartridge drawer 45 confronts the right side of the toner cartridges 46 (see FIG. 3).

(2-2) Moving Mechanism

The moving mechanism 111 is provided in the lower portion of the toner cartridge drawer 45. The moving mechanism 111 includes a rail member 121 as a supporting member, and a translation cam 122 as a moving member.

The rail member 121 is disposed in the bottom side of the toner cartridge drawer 45. The rail member 121 has a flat plate shape that is generally rectangular in a plan view and is elongated in the front-to-rear direction. The left-to-right and front-to-rear dimensions of the rail member 121 are substantially equivalent to those of the bottom wall 112 constituting the toner cartridge drawer 45.

Guide grooves 123 are formed in the rail member 121 for receiving the drawer-side rollers 117 of the toner cartridge drawer 45. Rail-side rollers 127 are also provided on the rail member 121.

Figure 5A:
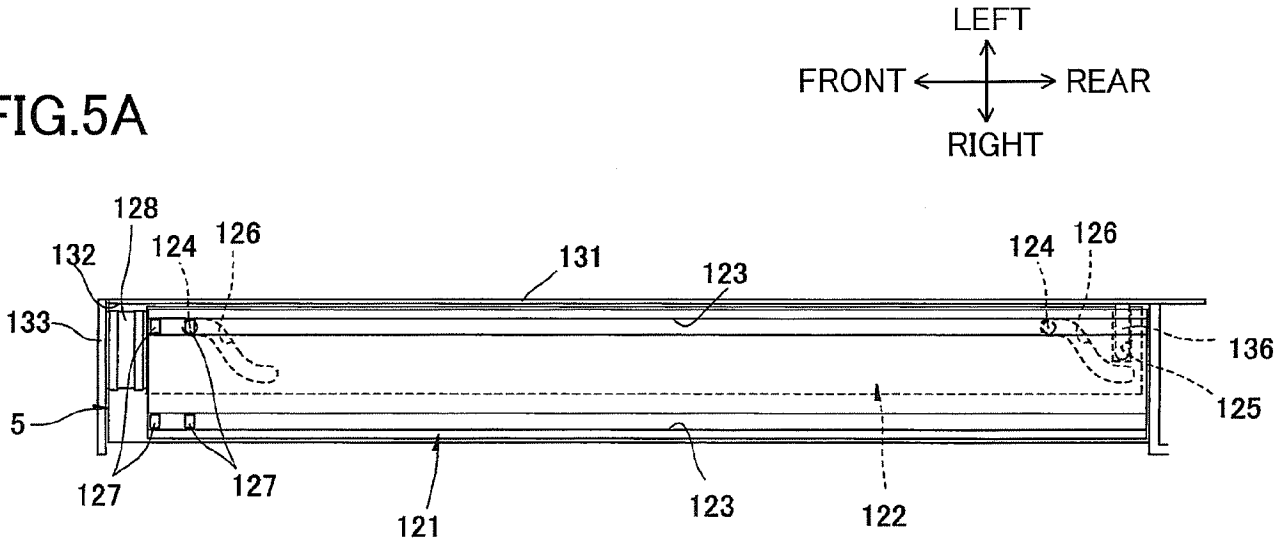
FIG. 5A is an explanatory diagram illustrating a toner-cartridge-accommodating section and illustrating a movement of a translation cam and a rail member in association with a movement of the cartridge-side front cover, wherein the cartridge-side front cover is closed and the translation cam is in a first position.
Figure 5B:
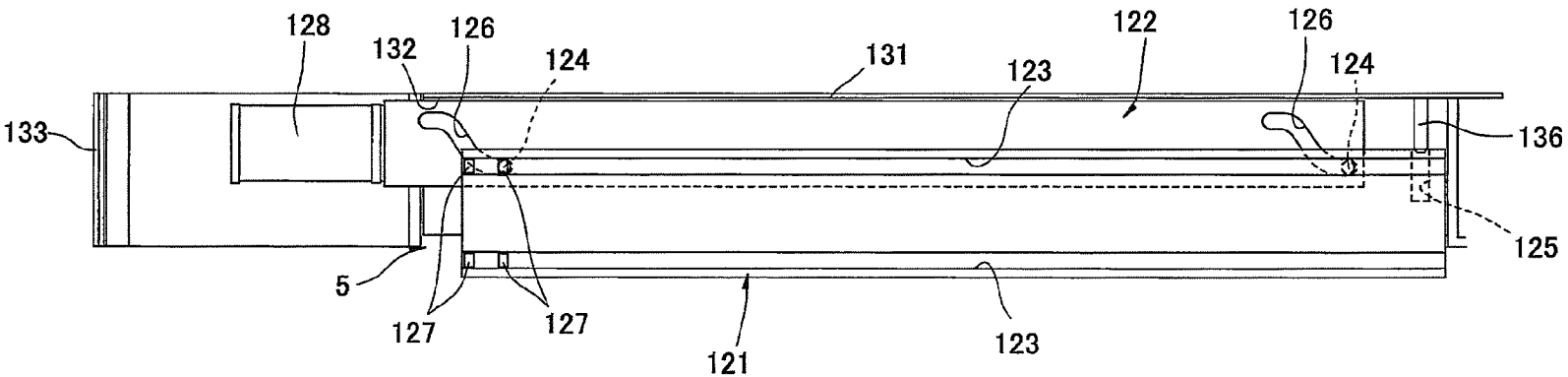
FIG. 5B is an explanatory diagram illustrating the toner-cartridge-accommodating section and illustrating the movement of the translation cam and the rail member in association with the movement of the cartridge-side front cover, wherein the cartridge-side front cover is opened and the translation cam is in a second position.

As shown in FIGS. 5A and 5B, the guide grooves 123 are provided one in each of the left and right edge portions of the rail member 121. The guide grooves 123 are recessed downward into the top surface of the rail member 121 and are substantially linear, extending in the front-to-rear direction. The guide grooves 123 extend across the entire rail member 121 in the front-to-rear direction.

The rail-side rollers 127 are rotatably provided in the front ends of the guide grooves 123 such that their top portions protrude upward from the guide grooves 123.

Formed on the rail member 121 are guide bosses 124 that are fitted into cam grooves 126 of the translation cam 122, and a restricting-boss insertion hole 125 for inserting a restricting boss 136 described later in the main casing 2.

The guide bosses 124 are provided on the left edge of the rail member 121, with one on both front and rear ends thereof. Each guide boss 124 is generally columnar in shape and extends downward from the bottom surface of the rail member 121.

The restricting-boss insertion hole 125 is formed in the rear end of the rail member 121 and is recessed rightward in the left surface of the rail member 121.

The translation cam 122 is disposed on the bottom side of the rail member 121 and can slide in forward and rearward directions. The translation cam 122 has a flat plate shape elongated in the front-to-rear direction and is generally rectangular in a plan view. The front-to-rear length of the translation cam 122 is approximately equivalent to that of the rail member 121, while the left-to-right dimension is smaller than that of the rail member 121.

Two cam grooves 126 as a pair of moving portions are formed in the translation cam 122, with one provided at each of the front and rear ends thereof. Each of the cam grooves 126 is generally S-shaped in a plan view, with one end positioned near the left edge and further forward connected to the other end positioned near the right edge and further rearward. Both of the cam grooves 126 have a width sufficient to receive the guide bosses 124 of the rail member 121.

The translation cam 122 is provided in the toner-cartridge-accommodating section 5 and is capable of sliding (reciprocating) between a first position (see FIG. 5A) accommodated in the toner-cartridge-accommodating section 5, and a second position (see FIG. 5B) in which the front end of the translation cam 122 protrudes forward from the cartridge-side access opening 132.

A coupling member coupling member 128 is provided on the front cover 133. The front end of the translation cam 122 is coupled to the through the coupling member 128.

Further, when the translation cam 122 is in the first position, the rail member 121 overlaps the translation cam 122, with the guide bosses 124 fitted into the front ends of the cam grooves 126.

The toner cartridge drawer 45 is positioned over the rail member 121, with the drawer-side rollers 117 fitted inside the guide grooves 123 of the rail member 121. At this time, the rail-side rollers 127 of the rail member 121 contact the bottom side of the bottom wall 112 constituting the toner cartridge drawer 45.

4. Main Casing

As shown in FIGS. 2, 3, 8, and 9, a partitioning wall 131 is provided in the main casing 2 for separating the image-forming unit 4 and toner-cartridge-accommodating section 5. Process-unit guide grooves 134 are formed in the main casing 2 for guiding the process unit 23 as the process unit 23 slides.

The partitioning wall 131 has a general flat plate shape. The partitioning wall 131 is disposed between the image-forming unit 4 and toner-cartridge-accommodating section 5. Five through-holes 135 are formed in the partitioning wall 131 to allow insertion of the four supply cylinders 98 of the toner cartridges 46 and the waste-toner-conveying cylinder 104. Further, the restricting boss 136 is provided on the partitioning wall 131 for restricting the rail member 121 from moving in the forward and rearward directions (see FIGS. 5A and 5B).

The through-holes 135 are substantially circular in a side view and are arranged at positions spaced in the front-to-rear direction that correspond to the supply cylinders 98 of the toner cartridges 46 and the waste-toner-conveying cylinder 104.

The restricting boss 136 is formed on the rear end of the partitioning wall 131 at a position corresponding to the restricting-boss insertion hole 125. The restricting boss 136 protrudes rightward from the right surface of the partitioning wall 131 (see FIGS. 5A and 5B). The restricting boss 136 is inserted into the restricting-boss insertion hole 125 of the rail member 121 (see FIGS. 5A and 5B).

One of the process-unit guide grooves 134 is formed in the right surface of the left wall of the main casing 2 while the other is formed in the left surface of the partitioning wall 131. The process-unit guide grooves 134 extend in the front-to-rear direction and are substantially linear. The process-unit guide grooves 134 have a width (vertical dimension) sufficient to receive the guide rollers 55 of the process unit 23.

5. Operations for Mounting and Removing the Toner Cartridges

To remove the toner cartridges 46 mounted in the main casing 2, first the operator places the front cover 133 in the open position, as shown in FIG. 2, to expose the access opening 132.

When the front cover 133 is moved from the closed position to the open position, the translation cam 122 is pulled forward through the coupling member 128, moving the translation cam 122 from the first position shown in FIG. 5A to the second position shown in FIG. 5B.

As the translation cam 122 is pulled toward the second position, the guide bosses 124 are pressed rightward by the corresponding cam grooves 126. Accordingly, the rail member 121 moves rightward while being restricted from moving in forward and rearward directions by the restricting boss 136.

As shown in FIG. 6B, the toner cartridge drawer 45 also moves rightward at the same time as the rail member 121. In this way, the toner cartridge drawer 45 moves rightward from the process unit 23 into the retracted position, as illustrated in FIG. 2. At this time, both the toner cartridge drawer 45 and the rail member 121 are exposed on the right side of the main casing 2.

Further, as shown in FIG. 4, the supply cylinders 98 of the toner cartridges 46 are retracted out through the corresponding through-holes 135 of the partitioning wall 131 to the right side of the partitioning wall 131. In other words, the supply cylinders 98 of the toner cartridges 46 are retracted from the receiving cylinders 69 of the corresponding process cartridges 26, interrupting communication between the supply openings 99 of the supply cylinders 98 and the corresponding reception openings 70 of the receiving cylinders 69.

After this operation, the toner cartridge drawer 45 can be pulled forward. Note that the right tip of the restricting boss 136 remains slightly inserted into the left end of the restricting-boss insertion hole 125, restricting the rail member 121 from moving forward as the toner cartridge drawer 45 is pulled forward.

In addition, the urging force of the compression springs 103 moves the corresponding-side shutters 101 into the closed position. Similarly, the urging force of the compression springs 73 moves the corresponding shutters 71 into the closed position.

Figure 7:
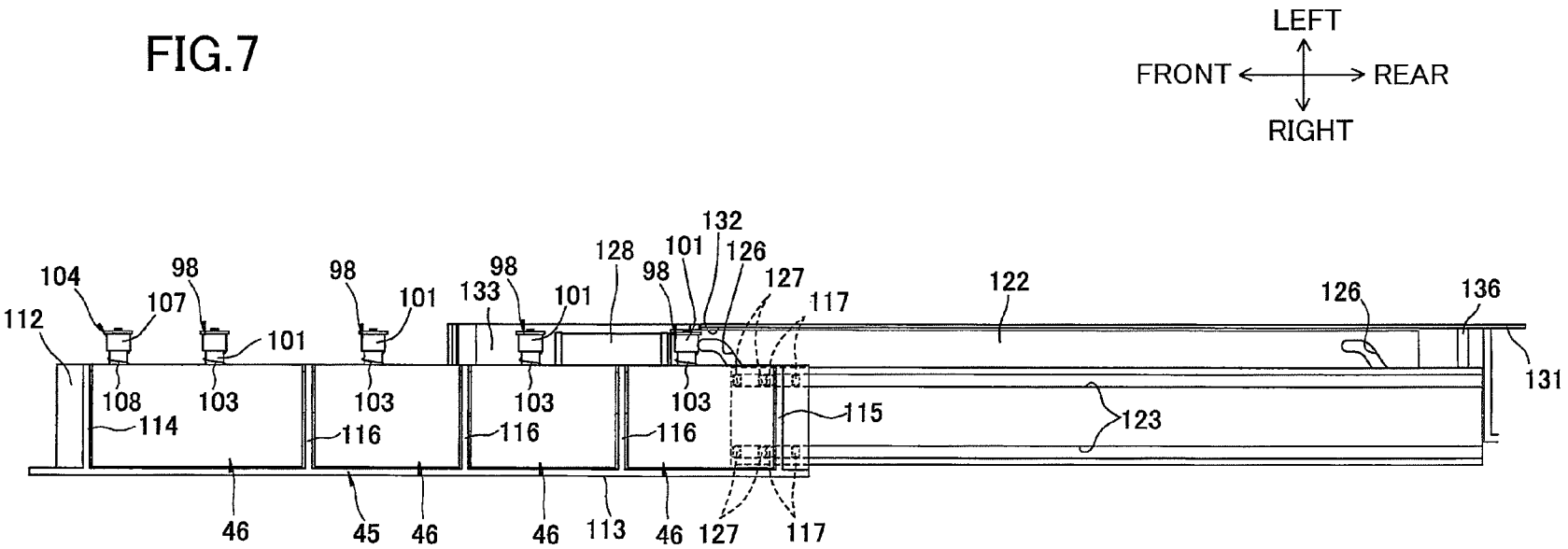
FIG. 7 is an explanatory diagram illustrating the toner-cartridge-accommodating section and illustrating the movement of the toner cartridge drawer shown in FIG. 2, wherein the toner cartridge drawer is in a pulled-out position.

To move the toner cartridges 46, the operator pulls the toner cartridge drawer 45 forward through the access opening 132. When the toner cartridge drawer 45 reaches the pulled-out position, the drawer-side rollers 117 contact the rear side of the rail-side rollers 127, as shown in FIG. 7. This contact between the rail-side rollers 127 and the drawer-side rollers 117 restricts the toner cartridge drawer 45 from being pulled farther.

To remove the toner cartridges 46, the operator lifts the toner cartridges 46 up and out of the toner cartridge drawer 45. This completes the operation to remove toner cartridges 46 from the main casing 2.

In order to mount toner cartridges 46 in the main casing 2, the procedure described above for removing the toner cartridges 46 is performed in reverse.

Specifically, while the toner cartridge drawer 45 is disposed in the pulled-out position, the operator inserts the toner cartridges 46 into the toner cartridge drawer 45 from above to a prescribed position within the toner cartridge drawer 45.

To mount the toner cartridges 46 in the main casing 2, the operator then pushes the toner cartridge drawer 45 rearward through the access opening 132. As the toner cartridge drawer 45 is pushed rearward, the rear end of the toner cartridge drawer 45 contacts the rear wall of the toner-cartridge-accommodating section 5. At this time, the toner cartridge drawer 45 is in the retracted position In this position, the supply cylinders 98 of the toner cartridge 46 face the right sides of the receiving cylinders 69 in the corresponding process cartridges 26 through the through-holes 135 formed in the partitioning wall 131. The waste-toner-conveying cylinder 104 of the toner cartridge 46 confronts the right side of the waste toner reservoir 87 in the black process cartridge 26K through the through-hole 135 of the partitioning wall 131.

In order to mount the toner cartridges 46 in the main casing 2, the operator places the front cover 133 in the closed position, thereby covering the access opening 132. As the front cover 133 moves from the open position to the closed position, the translation cam 122 is pressed rearward by the coupling member 128, as shown in FIG. 5, moving from the second position (see FIG. 5B) to the first position (see FIG. 5A).

At this time, the guide bosses 124 are pressed leftward by the corresponding cam grooves 126, moving the rail member 121 leftward while the restricting boss 136 restricts front-to-rear movement of the rail member 121.

The toner cartridge drawer 45 also moves leftward at the same time as the rail member 121, as illustrated in FIG. 6B. As a result, the supply cylinders 98 of the toner cartridges 46 are inserted into the corresponding through-holes 135 in the partitioning wall 131 until the supply cylinders 98 contact the receiving cylinders 69 of the corresponding process cartridges 26 from the right side thereof, as shown in FIG. 3.

At the same time, the supply cylinders 98 of the toner cartridges 46 contact the right ends of the shutters 71 in the corresponding process cartridges 26, while the shutters 101 of the toner cartridges 46 contact the right ends of the receiving cylinders 69 in the corresponding process cartridges 26. As the toner cartridge drawer 45 continues to move leftward, the supply cylinders 98 of the toner cartridges 46 press the shutters 71 leftward against the urging force of the compression springs 73 and are inserted into the corresponding receiving cylinders 69. At this time, the shutters 101 of the toner cartridges 46 are restricted from moving leftward by the right ends of the receiving cylinders 69. Consequently, the shutters 101 move rightward relative to the supply cylinders 98 against the urging force of the compression springs 103.

When the toner cartridge drawer 45 reaches the mounted position, the shutters 71 are in the open position, and the shutters 101 are in the open position. In this state, the supply openings 99 of the supply cylinders 98 and the reception openings 70 of the receiving cylinders 69 oppose each other vertically and are in communication. Further, the fitting parts 102 of the supply cylinders 98 are fitted with the fitting members 75 of the corresponding receiving cylinders 69 through the coupling exposure holes 76 of the shutters 71 and are incapable of rotating relative to the fitting members 75.

This completes the process for mounting the toner cartridges 46 in the main casing 2.

6. Operations for Supplying Toner from the Toner Cartridges to the Process Cartridges At the beginning of an image-forming operation performed on the printer 1, a drive source (not shown) in the main casing 2 inputs a drive force into the drive input gears 77 of the receiving cylinders 69. As shown in FIG. 3, the drive force is transmitted to the auger screws 100 of the toner cartridges 46 via the couplings 72 of the receiving cylinders 69 for rotating the auger screws 100.

The drive source (not shown) provided in the main casing 2 also inputs a drive force into the drive gears 84 of the toner reservoirs 34. The drive force is transmitted to the toner-conveying members 81 of the toner reservoirs 34 to rotate the same.

As a result, the auger screws 100 convey toner, which has been supplied from the toner-accommodating sections 95 of the toner cartridges 46 into the supply cylinders 98 through the through-holes 97, leftward through the supply channel 96 and the supply cylinders 98. The toner conveyed leftward in the supply channel 96 and the supply cylinders 98 is supplied through the first reception openings 70 formed in the process cartridges 26 via the supply openings 99.

Toner supplied through the first reception openings 70 is conveyed leftward through the conveying cylinders 68 by the auger screws 83 of the toner-conveying members 81 and is supplied into the toner reservoirs 34 of the process cartridges 26.

Toner supplied to the toner reservoirs 34 is subsequently agitated by the agitators 82 of the toner-conveying members 81 while being conveyed leftward through the toner reservoirs 34. The toner is supplied through the toner supply holes 64 into the first frames 62 of the developing devices 30.

The toner supplied into the first frames 62 is accumulated therein and subsequently supplied to the developing rollers 31 by the supply rollers 32, as described above.

The auger screws 67 in the first frames 62 (see FIG. 1) convey toner in the first frames 62 from the left side toward the right side. Excess toner passes through the toner recovery holes 65 and is collected in the toner reservoirs 34 so that the level of toner in the first frames 62 does not exceed a prescribed level.

7. Mounting and Removing the Process Cartridges

To remove the process cartridges 26 when the process cartridges 26 are mounted in the main casing 2, the operator first places the front cover 7 in the open position, as shown in FIG. 2, thereby exposing the access opening 6. Subsequently, the operator places the front cover 7 in the open position, thereby retracting the supply cylinders 98 of the toner cartridges 46 to the right side of the partitioning wall 131.

Figure 9:
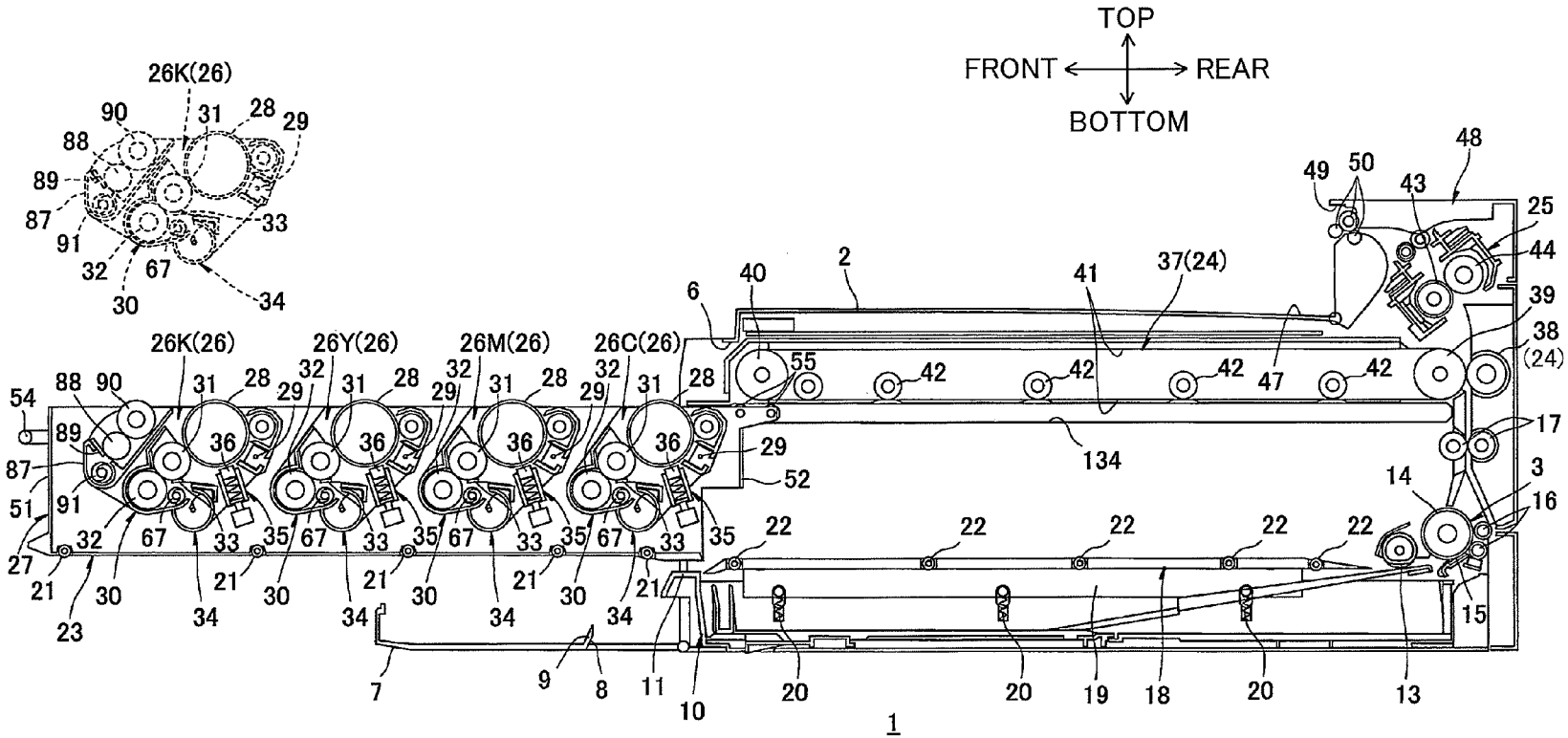
FIG. 9 is an explanatory diagram illustrating the removal and mounting of the process cartridge shown in FIG. 1.

Next, the operator pulls the process unit 23 forward through the access opening 6. As the process unit 23 is pulled forward, the guide rollers 55 of the process frame 27 are guided in the process-unit guide grooves 134 formed in the main casing 2 until the process unit 23 reaches the pulled-out position as shown in FIG. 9.

In this state, the operator can lift the process cartridges 26 up and out of the process frame 27, thereby completing the removal of the process cartridges 26 from the main casing 2.

When mounting the process cartridges 26 in the main casing 2, the procedure for removing the process cartridges 26 described above is performed in reverse. That is, while the process frame 27 is disposed in the pulled-out position, the operator inserts the process cartridges 26 into the process frame 27 from above until the process cartridges 26 are in a prescribed position.

Next, the operator pushes the process unit 23 rearward through the access opening 6. As the process unit 23 moves rearward, the guide rollers 55 of the process frame 27 are guided in the process-unit guide grooves 134 formed in the main casing 2 until the process unit 23 reaches the mounted position.

The operator moves the front cover 133 into its closed position to cover the access opening 132, thereby inserting the supply cylinder 98 into the receiving cylinder 69. Next, the operator moves the front cover 7 into its closed position to cover the access opening 6, thereby completing the operation for mounting the process cartridges 26 in the main casing 2.

8. Operational Advantages (1) As illustrated in FIGS. 6 and 7, the toner cartridge drawer 45 according to the printer 1 of the above embodiment is retracted rightward from the process cartridges 26, moving from the mounted position (see FIG. 6A) to the retracted position (see FIG. 6B), interrupting communication between the supply openings 99 of the toner cartridges 46 and the reception openings 70 of the corresponding process cartridges 26. Thereafter, the toner cartridge drawer 45 can be pulled forward out of the main casing 2 from this retracted position.

Hence, by configuring the toner cartridges 46 to communicate directly with the corresponding process cartridges 26 in the left-to-right direction, the toner cartridges 46 can be mounted in and removed from the main casing 2 in the front-to-rear direction simply by retracting the toner cartridges 46 rightward from the process cartridges 26 a distance sufficient to disengage the supply openings 99 and reception openings 70.

With this configuration, the space on the right side of the printer 1 required for mounting and removing the toner cartridges 46 can be greatly reduced, thereby minimizing the space required for installing the printer 1.

Further, even when the printer 1 is installed on a shelf or other location with limited space on left and right sides of the printer 1, the toner cartridge drawer 45 can be pulled forward for replacing the toner cartridges 46. As a result, this configuration enhances the user's options for locations in which the printer 1 can be installed.

(2) As shown in FIG. 4, the translation cam 122 of the printer 1 moves the toner cartridge drawer 45 from the mounted position (see FIG. 6A) to the retracted position (see FIG. 6B) together with the rail member 121. Therefore, the toner cartridge drawer 45 can be pulled from the retracted position to the pulled-out position (see FIG. 7).

Hence, through a simple structure, the translation cam 122 can move both the rail member 121 and the toner cartridge drawer 45 rightward, enabling the toner cartridge drawer 45 to be moved from the mounted position to the retracted position. From the retracted position, the toner cartridge drawer 45 can be pulled forward to the pulled-out position.

(3) Further, when moving forward, the translation cam 122 moves the rail member 121 so that the toner cartridge drawer 45 moves from the mounted position to the retracted position (see FIG. 5B). When moving rearward, the translation cam 122 moves the rail member 121 so that the toner cartridge drawer 45 moves from the retracted position to the mounted position (see FIG. 5A). Hence, through a simple structure, the toner cartridge drawer 45 can be moved between the mounted position and the retracted position.

(4) As shown in FIGS. 5A and 5B, two of the cam grooves 126 are formed in the translation cam 122 for moving both front and rear ends of the rail member 121 rightward. With this construction, both front and rear ends of the rail member 121 can be smoothly moved through only an operation on the front end thereof.

(5) As shown in FIGS. 2, 6A, and 6B, the translation cam 122 of the printer 1 is coupled to the front cover 133 through the coupling member 128. Hence, the toner cartridge drawer 45 can be moved from the mounted position to the retracted position in association with movement of the front cover 133 from the closed position to the open position, and can be moved from the retracted position to the mounted position in association with movement of the front cover 133 from the open position to the closed position.

(6) As shown in FIG. 2, the toner cartridge drawer 45 and rail member 121 of the printer 1 are exposed on the right side of the main casing 2 when disposed in the retracted position. Accordingly, space on the right side of the main casing 2 can be used to dispose the toner cartridge drawer 45 in the retracted position. Since there is no need to provide space in the main casing 2 for retracting the toner cartridge drawer 45, this construction enables the printer 1 to be configured more compactly in the left-to-right direction and can reduce the installation area required for the printer 1.

(7) As shown in FIG. 3, the right wall 113 of the toner cartridge drawer 45 can be used as the right wall of the printer 1.

(8) As shown in FIG. 3, the supply cylinders 98 of the toner cartridges 46 having supply openings 99 formed therein are received in the receiving cylinders 69 of the corresponding process cartridges 26 having reception openings 70 formed therein. With this construction, the supply openings 99 communicate with the reception openings 70. Hence, through a simple structure, it is possible to couple the receiving cylinders 69 and supply cylinders 98 and provide direct communication between the respective reception openings 70 and supply openings 99.

(9) As shown in FIG. 4, when the toner cartridge drawer 45 is in the retracted position, the shutters 71 can close the respective reception openings 70 and the shutters 101 can close the supply openings 99. Hence, through a simple structure, it is possible to prevent toner from leaking out of the toner cartridges 46 and process cartridges 26 when the toner cartridge drawer 45 is in the retracted position.

(10) As shown in FIG. 9, all of the process cartridges 26 can be mounted in or pulled-out of the main casing 2 in forward and rearward directions. This construction allows an operator to perform maintenance on the process cartridges 26 from the front side of the printer 1.

9. Second Embodiment

Figure 10A:
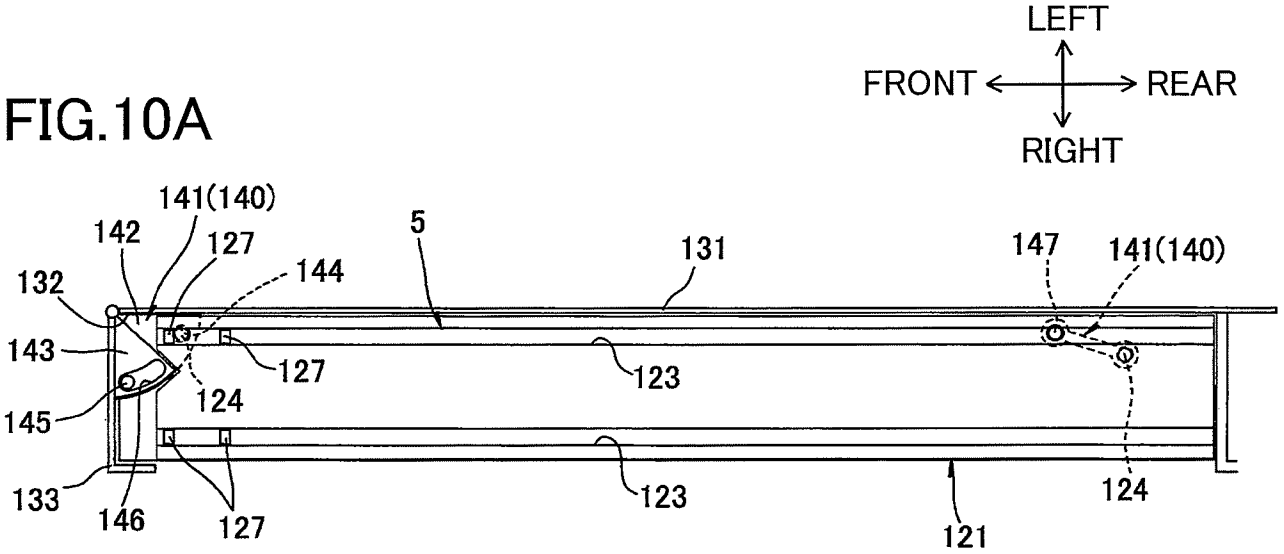
FIG. 10A is an explanatory diagram illustrating a toner-cartridge-accommodating section of a printer according to a second embodiment and illustrating a movement of a rail member in association with a movement of the cartridge-side front cover, wherein the cartridge-side front cover is closed.
Figure 10B:
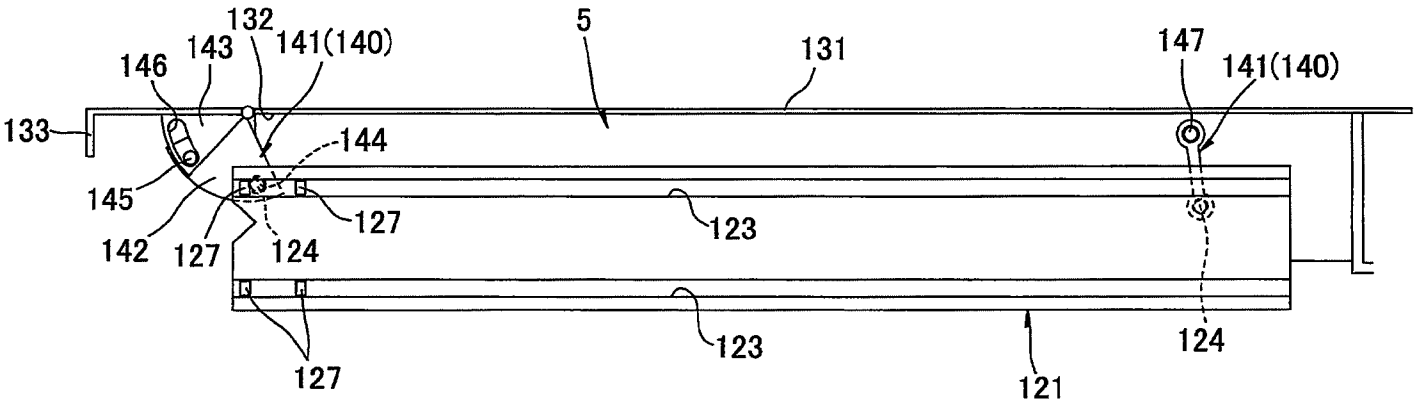
FIG. 10B is an explanatory diagram illustrating the toner-cartridge-accommodating section of the printer according to the second embodiment and illustrating the movement of the rail member in association with the movement of the cartridge-side front cover, wherein the cartridge-side front cover is opened.

Next, the printer 1 according to a second embodiment will be described with reference to FIGS. 10A and 10B, wherein like parts and components are designated with the same reference numerals used in the first embodiment to avoid duplicating description.

In the first embodiment described above, the translation cam 122 of the moving mechanism 111 directly moves the rail member 121 rightward. However, in the second embodiment, a pivoting mechanism 140 as a moving member moves the rail member 121 in a rightward and forward pivoting motion, as illustrated in FIG. 10.

More specifically, the front cover 133 in the second embodiment is provided so as to be capable of pivoting (moving) about its left end between a closed position for closing the access opening 132 and an open position for exposing the cartridge-side access opening 132.

The moving mechanism 111 includes the pivoting mechanism 140 and the rail member 121.

The pivoting mechanism 140 is provided with a pair of pivoting members 141 as a pair of moving portions. The front pivoting member 141 is disposed on the front end of the toner-cartridge-accommodating section 5. The front pivoting member 141 includes a first pivoting plate 142 disposed beneath the rail member 121, and a second pivoting plate 143 positioned over the first pivoting plate 142. The second pivoting plate 143 confronts the front side of the rail member 121.

The first pivoting plate 142 is a plate-like member that is generally fan-shaped with a central angle of approximately 90 degrees. The central angle portion of the first pivoting plate 142 is pivotably supported about a support point on the front cover 133. A guide-boss insertion hole 144 is formed in the first pivoting plate 142. The first pivoting plate 142 also includes a coupling boss 145.

The guide-boss insertion hole 144 is generally circular in a plan view and penetrates the rear end of the first pivoting plate 142. The guide-boss insertion hole 144 has a slightly larger diameter than the outer diameter of the guide bosses 124 provided on the rail member 121. The front guide boss 124 of the rail member 121 is fitted inside the guide-boss insertion hole 144.

The coupling boss 145 is generally columnar-shaped and protrudes upward from the top surface of the first pivoting plate 142 near the front edge thereof.

The second pivoting plate 143 is a plate-like member and is substantially fan-shaped with a central angle of approximately 45 degrees. The central angle portion of the second pivoting plate 143 is connected to a pivot point on the front cover 133, while the front edge of the second pivoting plate 143 is connected to the rear surface of the front cover 133. A coupling groove 146 is formed in the second pivoting plate 143.

The coupling groove 146 has a general arc shape, extending in the front-to-rear direction, and penetrates a radially outer portion of the second pivoting plate 143. The coupling groove 146 has a slightly larger width than the outer diameter of the coupling boss 145. The coupling boss 145 of the first pivoting plate 142 is fitted inside the coupling groove 146 and is capable of sliding freely therein.

The rear pivoting member 141 is generally rod-shaped, extending between a first end and a second end. Both end portions of the rear pivoting member 141 are generally annular in a plan view. The first end of the pivoting member 141 is pivotably fitted around a support boss 147 provided in the toner-cartridge-accommodating section 5, while the second end is pivotably fitted around the rear guide boss 124 of the rail member 121.

When the front cover 133 is moved from the closed position to the open position while the toner cartridge drawer 45 is disposed in the mounted position (see FIG. 10A), the second pivoting plate 143 pivots together with the front cover 133. When the second pivoting plate 143 pivots, the coupling boss 145 moves within the coupling groove 146 from the front end to the rear end thereof.

The second pivoting plate 143 subsequently pulls the coupling boss 145 of the first pivoting plate 142 forward, causing the first pivoting plate 142 to pivot about the pivot point on the front cover 133. As a result, the front end of the rail member 121 is pulled frontward and rightward, moving the rail member 121 rightward and placing the toner cartridge drawer 45 in the retracted position (see FIG. 10B). Note that when the rail member 121 moves rightward, the rear end of the rail member 121 moves forward and rightward via the rear pivoting member 141 to follow the front end of the rail member 121.

Conversely, when the front cover 133 is moved from the open position to the closed position, the second pivoting plate 143 contacts the front side of the rail member 121 and pushes the rail member 121 rearward. The rail member 121 moves leftward and rearward while supported by the first pivoting plate 142 and the rear pivoting member 141. As a result, the toner cartridge drawer 45 is placed in the mounted position (see FIG. 10A).

The printer 1 according to the second embodiment obtains the same operational advantages as the first embodiment described above.

10. Third Embodiment

Next, the printer 1 according to a third embodiment will be described with reference to FIGS. 11A-11C, wherein like parts and components are designated with the same reference numerals used in the first embodiment to avoid duplicating description.

In the first embodiment described above, the translation cam 122 coupled with the front cover 133 moves the rail member 121 rightward in association with the opening movement of the front cover 133. However, in the third embodiment shown in FIGS. 11A-11C, rack gears 151 are provided on the bottom surface of the rail member 121 in place of the guide bosses 124 for moving the rail member 121 in left and right directions.

Specifically, the moving mechanism 111 in the third embodiment includes the rail member 121 and a linkage mechanism 152 as a moving member.

The rack gears 151 provided on the rail member 121 extend in the left-to-right direction and protrude downward from the bottom surface of the rail member 121. One of the rack gears 151 is provided each on the front and rear ends of the rail member 121. Gear teeth are provided on the front surface of each rack gear 151.

The linkage mechanism 152 includes a pair of front and rear rotating members 153 as a pair of moving portions, and a coupling member 154.

Each rotating member 153 includes a gear part 155 engaged with the respective front rack gear 151, and a coupling part 156 coupled to the respective coupling member 154.

The gear part 155 is substantially fan-shaped in a plan view with a central angle of approximately 90 degrees. Gear teeth are formed along the peripheral edge of the gear part 155. The gear part 155 is pivotably supported at its central angle portion on a support shaft 157 provided in the toner-cartridge-accommodating section 5. When the toner cartridge drawer 45 is disposed in the mounted position, the gear part 155 of each rotating member 153 engages with the respective rack gear 151 from the front side at a downstream end of the gear part 155 with respect to the clockwise direction in a plan view (see FIG. 11A).

The coupling parts 156 are substantially rod-shaped and extend from the central angle portion of the gear parts 155. More specifically, when the toner cartridge drawer 45 is in the mounted position, the coupling parts 156 are substantially L-shaped, extending rightward from the central angle portion of the gear parts 155, then bending rearward. An operating part 158 is provided on the front coupling part 156.

The operating part 158 is generally rod-shaped and extends rightward from the bent portion of the front coupling part 156 when the toner cartridge drawer 45 is in the mounted position.

The coupling member 154 is generally rod-shaped and extends in the front-to-rear direction. The front end of the coupling member 154 is rotatably coupled to the free end of the front coupling part 156 (the rear end when the toner cartridge drawer 45 is in the mounted position (see FIG. 11A). The rear end of the coupling member 154 is rotatably coupled to the free end of the rear coupling part 156.

Figures 11A, 11B, 11C:
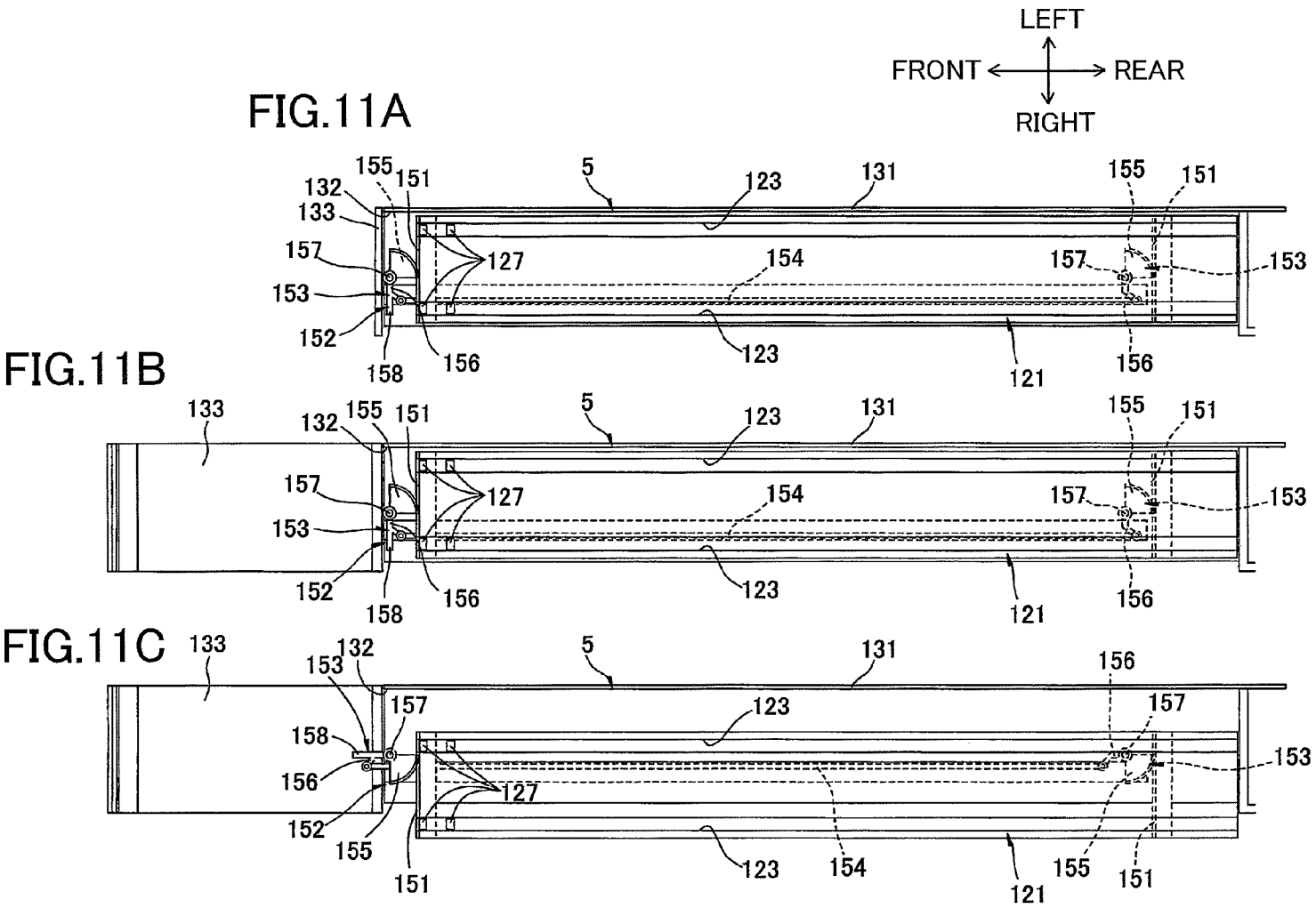
FIG. 11A is an explanatory diagram illustrating a toner-cartridge-accommodating section of a printer according to a third embodiment, wherein the cartridge-side front cover is closed.
FIG. 11B is an explanatory diagram illustrating the toner-cartridge-accommodating section of the printer according to the third embodiment, wherein the cartridge-side front cover is opened.
FIG. 11C is an explanatory diagram illustrating the toner-cartridge-accommodating section of the printer according to the third embodiment, wherein the toner cartridge drawer is in the retracted position.

To move the toner cartridge drawer 45 from the mounted position to the retracted position, first the operator places the front cover 133 in the open position (see FIG. 11B). Next, the operator grips the operating part 158 and rotates the front rotating member 153 clockwise in a plan view. As the front rotating member 153 is rotated clockwise, the rear rotating member 153 is also rotated clockwise in a plan view through the coupling member 154. Through this operation, the gear parts 155 of the front and rear rotating members 153 rotate clockwise in a plan view and transmit a rightward drive force to the corresponding rack gears 151 engaged with the gear parts 155. As a result, the rail member 121 is moved rightward, placing the toner cartridge drawer 45 in the retracted position (see FIG. 11C).

In order to move the toner cartridge drawer 45 from the retracted position to the mounted position, the operator first grips the operating part 158 and rotates the front rotating member 153 counterclockwise in a plan view. When the front rotating member 153 rotates counterclockwise, the rear rotating member 153 coupled to the front rotating member 153 via the coupling member 154 also rotates counterclockwise in a plan view. Through this operation, the gear parts 155 of both the front and rear rotating members 153 rotate counterclockwise in a plan view and transmit a leftward drive force to the rack gears 151 engaged with the gear parts 155. As a result, this operation moves the rail member 121 leftward and places the toner cartridge drawer 45 in the cartridge-side mounted position (see FIG. 11B). Next, the operator places the front cover 133 in the closed position (see FIG. 11A).

With the third embodiment described above, the front rotating member 153 of the linkage mechanism 152 includes the operating part 158 for operating the linkage mechanism 152. Hence, the linkage mechanism 152 can be operated through a simple structure.

The printer 1 according to the third embodiment can also obtain the same operational advantages as the printer 1 according to the first embodiment described above.

11. Fourth Embodiment

Next, the printer 1 according to a fourth embodiment will be described with reference to FIGS. 12 and 13, wherein like parts and components are designated with the same reference numerals used in the first embodiment to avoid duplicating description.

In the first embodiment described above, each process cartridge 26 is provided with the receiving cylinder 69 for receiving the supply cylinder 98 of the corresponding toner cartridge 46. The supply cylinder 98 is inserted into the receiving cylinder 69 to couple the process cartridge 26 to the toner cartridge 46.

However, in the fourth embodiment, the receiving cylinder 69 is eliminated from the process cartridge 26, while the conveying cylinder 68 is configured so that its right end protrudes into the toner-cartridge-accommodating section 5. In addition, the supply cylinder 98 is not provided in the toner cartridge 46, and the conveying cylinder 68 is inserted into the supply channel 96 to couple the process cartridge 26 and toner cartridge 46.

More specifically, in the fourth embodiment the through-hole 97 of the toner cartridge 46 is provided on the left side thereof in order to communicate with the left end of the supply channel 96. In the fourth embodiment, the conveying cylinder 68 functions as a receiving member, the supply channel 96 functions as a supply member, while the through-hole 97 functions as a supply opening.

Further, a cartridge-side shutter 161 as a second shutter is provided in each toner cartridge 46. The shutter 161 is generally cylindrical in shape, elongated in the left-to-right direction, and is closed on the left end. The shutter 161 has an outer diameter essentially equivalent to the outer diameter of the conveying cylinder 68 and a left-to-right dimension equivalent to about half that of the supply channel 96.

The shutter 161 is disposed inside the supply channel 96 so as to be capable of sliding between an open position (see FIG. 12) on the left end of the supply channel 96 for exposing the through-hole 97, and a closed position (see FIG. 13) on the right end of the supply channel 96 for closing the through-hole 97. Further, a compression spring 162 is interposed between the right wall of the supply channel 96 and the left wall of the shutter 161 for constantly urging the shutter 161 leftward toward the closed position (while the toner cartridge drawer 45 is in the retracted position).

A process-side shutter 164 as a first shutter is provided on the conveying cylinder 68 of each process cartridge 26. A flange part 163 is provided around the conveying cylinder 68 at a midpoint in the left-to-right direction thereof and protrudes radially outward from the outer peripheral surface of the conveying cylinder 68.

The shutter 164 is generally cylindrical in shape and is elongated in the left-to-right direction. The shutter 164 has an inner diameter substantially equal to the inner diameter of the supply channel 96 and a left-to-right length substantially equivalent to that of the shutter 161.

The shutter 164 is fitted around the conveying cylinder 68 and is disposed so as to be slidable between a closed position (see FIG. 13) on the right end of the conveying cylinder 68 for closing the reception opening 70, and an open position (see FIG. 12) retracted leftward from the open position for exposing the reception opening 70. A compression spring 165 is also interposed between the left end of the shutter 164 and the flange part 163 for constantly urging the shutter 164 rightward toward the closed position (while the toner cartridge drawer 45 is in the retracted position).

Figure 13:
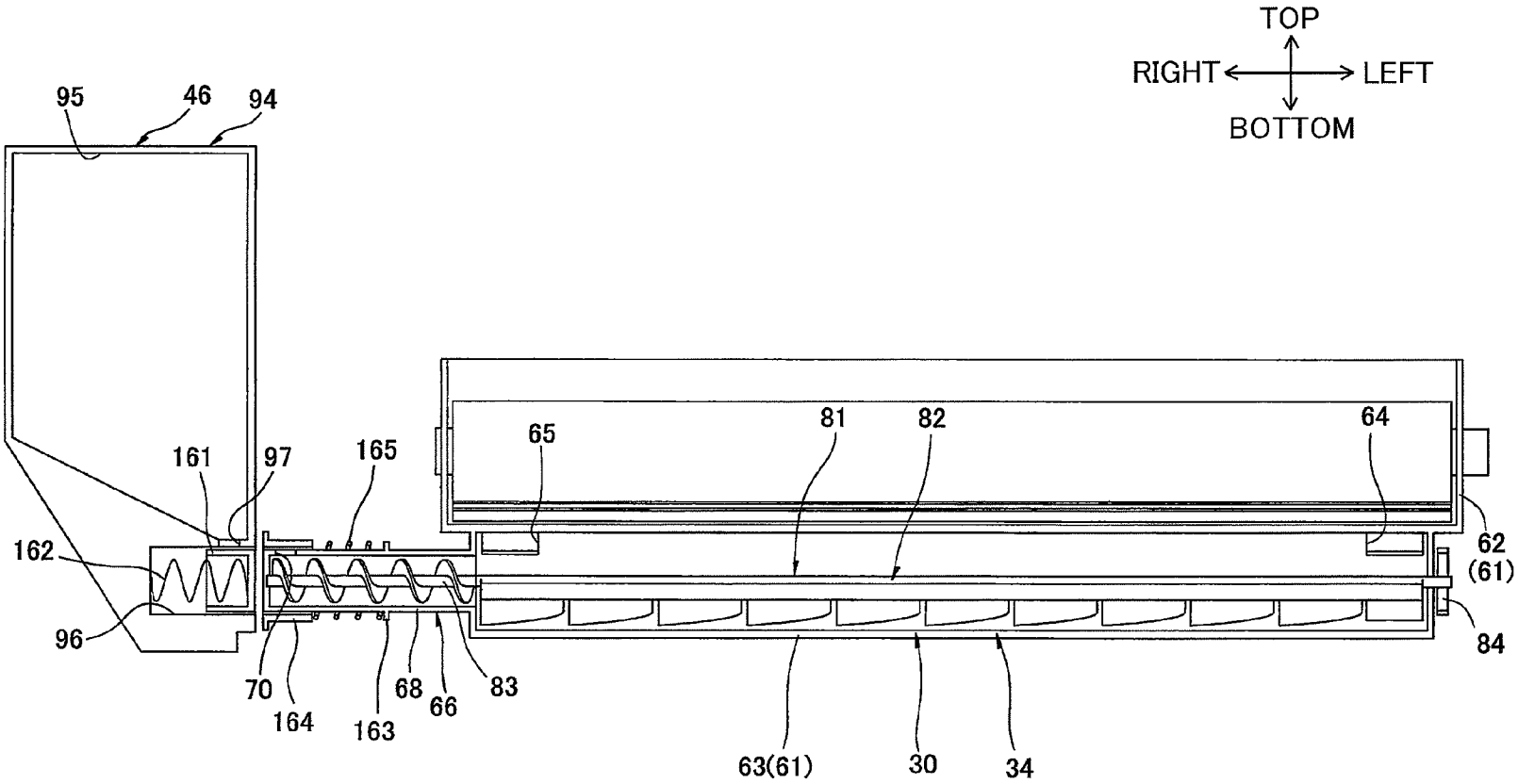
FIG. 13 is an explanatory diagram illustrating the movement of the toner cartridge of a printer according to the fourth embodiment, wherein the toner cartridge is separated from the process cartridge.

As shown in FIG. 13, when the toner cartridges 46 are brought closer toward the right sides of the process cartridges 26 by moving the toner cartridge drawer 45 from the retracted position to the mounted position, the right ends of conveying cylinders 68 in the process cartridges 26 contact the left sides of the shutters 161 in corresponding toner cartridges 46, while the right ends of the shutters 164 in the process cartridges 26 contact the left peripheral edges of the supply channels 96 formed on the corresponding toner cartridges 46.

As the toner cartridge drawer 45 moves further leftward, the supply channels 96 of the toner cartridge 46 become fitted over the corresponding conveying cylinders 68, while pushing the shutters 164 leftward against the urging force of the compression springs 165. At this time, the shutters 161 of the toner cartridges 46 are restricted from moving leftward by the right edges of the conveying cylinders 68 in the corresponding process cartridges 26. Consequently, the shutters 161 move rightward relative to the supply channels 96 against the urging force of the compression springs 162.

Figure 12:
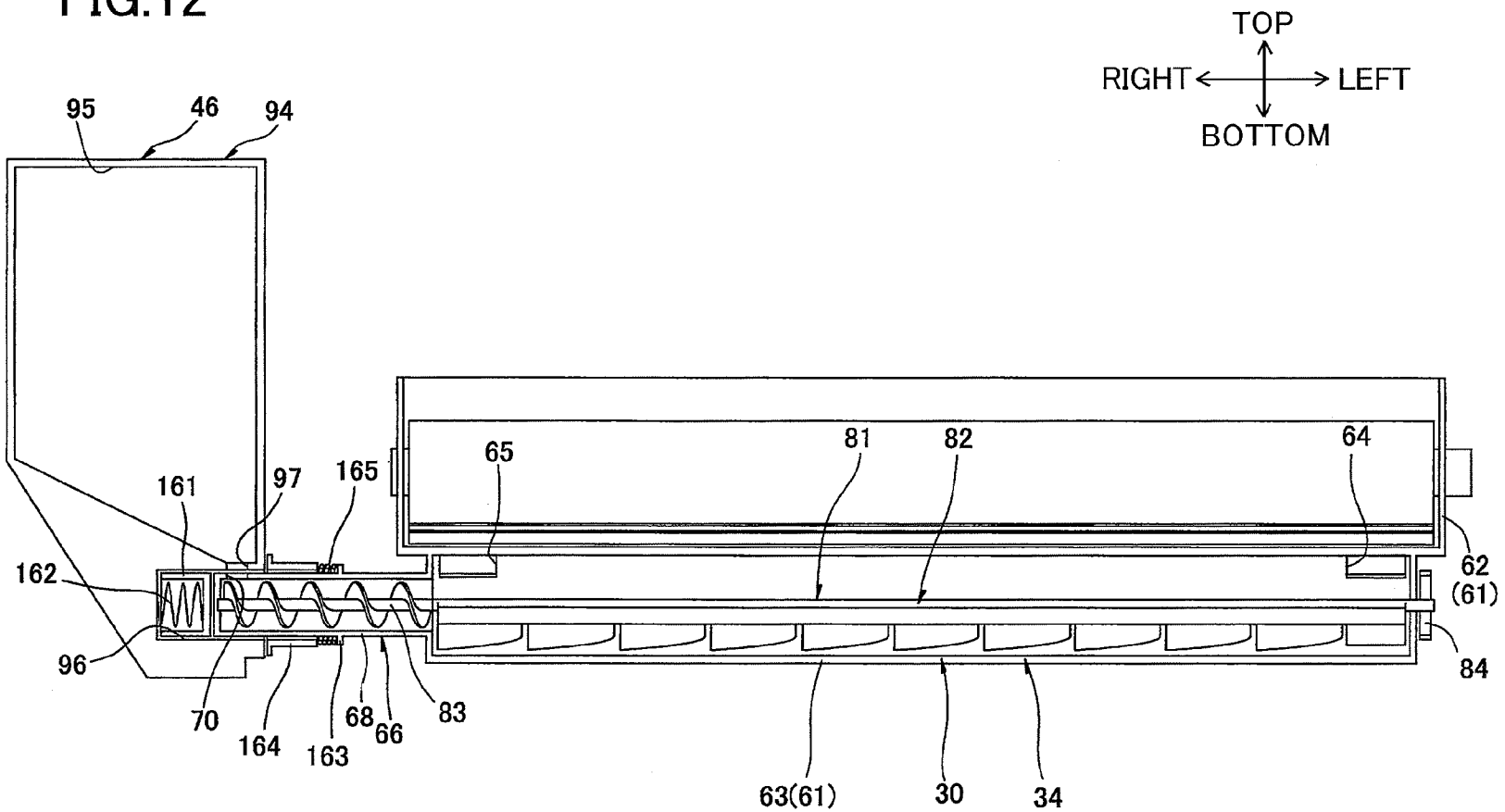
FIG. 12 is an explanatory diagram illustrating a movement of a toner cartridge of a printer according to a fourth embodiment, wherein the toner cartridge and process cartridge are connected.

When the toner cartridge drawer 45 is placed in the mounted position shown in FIG. 12, the shutters 164 are disposed in the open position, and the shutters 161 are disposed in the open position. At this time, the through-holes 97 of the toner cartridges 46 and the reception openings 70 of the process cartridges 26 are vertically aligned and in communication with each other.

As shown in FIGS. 12 and 13, the toner cartridge drawer 45 in the fourth embodiment is retracted rightward from the process cartridges 26, moving from the mounted position (see FIG. 12) to the retracted position (see FIG. 13), interrupting communication between the supply openings 99 of the toner cartridges 46 and the reception openings 70 of the corresponding process cartridges 26. Thereafter, the toner cartridge drawer 45 can be pulled forward from the retracted position out of the main casing 2.

By configuring the toner cartridges 46 to communicate directly with the corresponding process cartridges 26 in the left-to-right direction, the toner cartridges 46 can be mounted in and removed from the main casing 2 in the front-to-rear direction simply by retracting the toner cartridges 46 rightward from the process cartridges 26 a distance sufficient to disengage the supply openings 99 and reception openings 70.

As a result, the space on the right side of the printer 1 required for mounting and removing the toner cartridges 46 can be greatly reduced, thereby minimizing the space required for installing the printer 1.

The printer 1 according to the fourth embodiment can also obtain the same operational advantages as the printer 1 according to the first embodiment described above.

12. Fifth Embodiment

Figure 14:
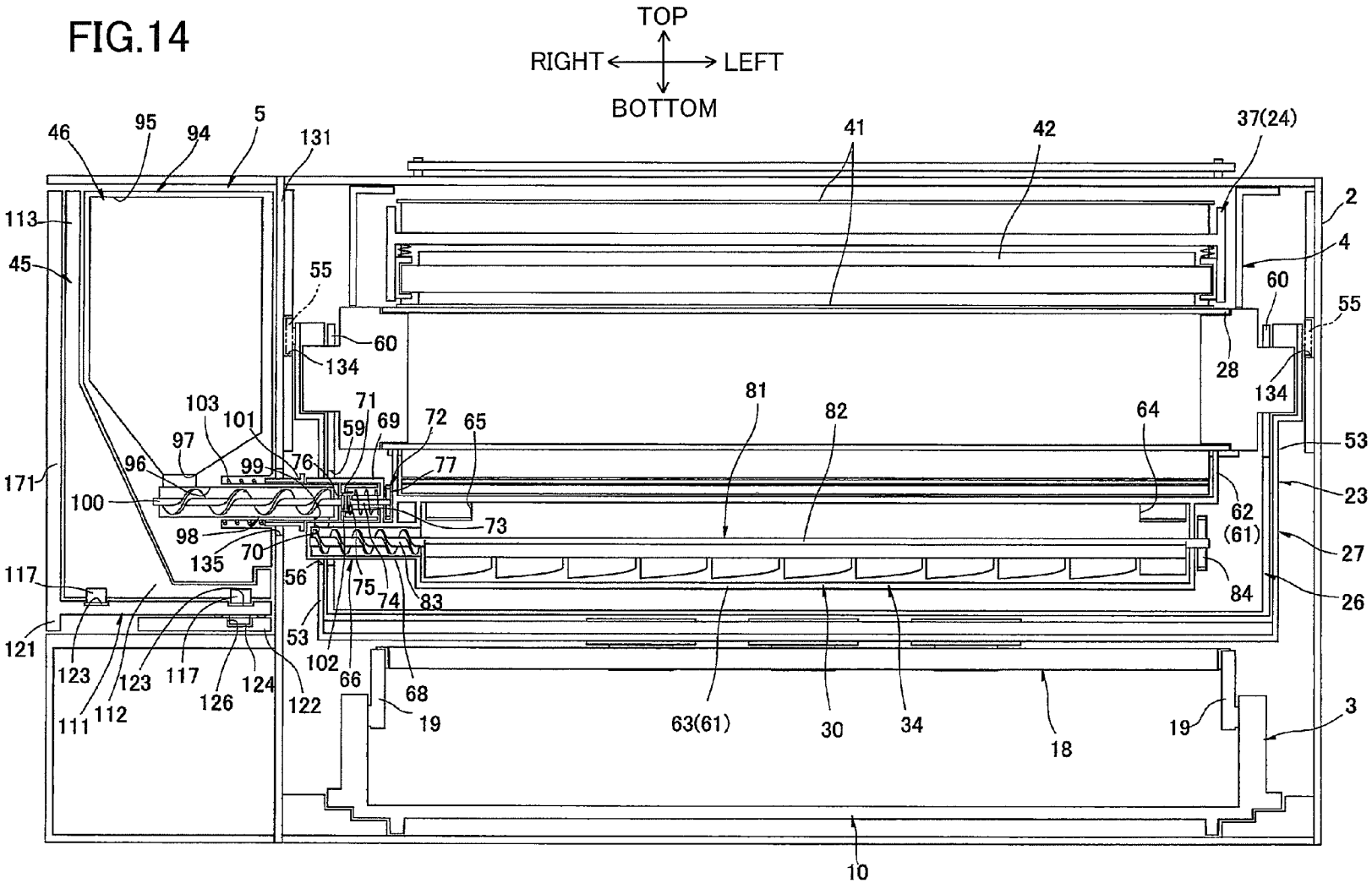
FIG. 14 is a cross-sectional view of a color printer according to a fifth embodiment, wherein a toner cartridge drawer is in a mounted position.

Next, the printer 1 according to a fifth embodiment will be described with reference to FIG. 14, wherein like parts and components are designated with the same reference numerals used in the first embodiment to avoid duplicating description.

In the first embodiment described above, the right wall 113 of the toner cartridge drawer 45 serves as the right wall of the main casing 2, as shown in FIG. 3. However, in the fifth embodiment, a right wall 171 as a side wall is provided on the right end of the rail member 121, as shown in FIG. 14. The right wall 171 is disposed on an opposite side of the toner cartridges 46 from the process cartridges 26 in the left-to-right direction.

Hence, in the fifth embodiment, the right wall 171 of the rail member 121 can be used to construct the right wall of the printer 1.

The printer 1 according to the fifth embodiment can obtain the same operational advantages as the first embodiment described above.

What is claimed is:

1. An image forming apparatus comprising:

a main casing;

a plurality of image forming units, each of the plurality of image forming units comprising a photosensitive drum, a developer carrying member disposed in confrontation with the photosensitive drum, and a receiving member formed with a reception opening configured to receive developer;

a plurality of developer cartridges, each of the plurality of developer cartridges configured to be provided for each of the plurality of image forming units, each of the plurality of developer cartridges comprising a developer accommodating section configured to accommodate developer and a supply member formed with a supply opening through which developer in the developer accommodating section is configured to be supplied to a corresponding one of the plurality of image forming units; and a cartridge supporting member configured to detachably support each of the plurality of developer cartridges, the cartridge supporting member configured to move between a first position and a second position via a third position, wherein the cartridge supporting member is mounted in the main casing and the supply opening and the reception opening are in communication with each other when the cartridge supporting member is in the first position and the cartridge supporting member is pulled outside the main casing from the first position when the cartridge supporting member is in the second position, wherein one of the receiving member and the supply member protrudes toward a remaining one of the receiving member and the supply member, wherein the remaining one of the receiving member and the supply member is configured to receive the one of the receiving member and the supply member, wherein the main casing includes an opening through which the cartridge supporting member is moved between the third position and the second position and an opening/closing member configured to be moved between an open position in which the opening is exposed and a closed position in which the opening is closed, and wherein the cartridge supporting member is moved from the first position to the third position in association with movement of the opening/closing member from the closed position to the open position, and the cartridge supporting member is moved from the third position to the first position in association with movement of the opening/closing member from the open position to the closed position.

2. The image forming apparatus according to claim 1, wherein the cartridge supporting member is moved away from the plurality of image forming units to interrupt a communication between the supply opening and the reception opening when the cartridge supporting member is in the third position.

3. The image forming apparatus according to claim 2, wherein the plurality of image forming units is juxtaposedly arrayed with each other in a predetermined direction, wherein each photosensitive drum has an axis extending in an axial direction perpendicular to the predetermined direction, wherein each of the plurality of developer cartridges is configured to be disposed in confrontation with a corresponding one of the plurality of image forming units in the axial direction.

4. The image forming apparatus according to claim 3, wherein the cartridge supporting member is moved away from the plurality of image forming units in the axial direction to interrupt a communication between the supply opening and the reception opening when the cartridge supporting member is in the third position.

5. The image forming apparatus according to claim 2, wherein the cartridge supporting member is exposed outside the main casing when the cartridge supporting member is in the third position.

6. The image forming apparatus according to claim 5, wherein the cartridge supporting member includes a side wall disposed in confrontation with the plurality of developer cartridges in an axial direction, the side wall being disposed on an opposite side of the plurality of developer cartridges from the plurality of the image forming units in the axial direction.

* * * * *